US011227499B2

(12) United States Patent
Wakayanagi et al.

(10) Patent No.: US 11,227,499 B2
(45) Date of Patent: Jan. 18, 2022

(54) DRIVING ASSISTANCE APPARATUS AND DRIVING ASSISTANCE METHOD

(71) Applicant: MITSUBISHI ELECTRIC CORPORATION, Tokyo (JP)

(72) Inventors: Haruhiko Wakayanagi, Tokyo (JP); Mitsuo Shimotani, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/763,613

(22) PCT Filed: Mar. 8, 2018

(86) PCT No.: PCT/JP2018/008970
§ 371 (c)(1),
(2) Date: May 13, 2020

(87) PCT Pub. No.: WO2019/171528
PCT Pub. Date: Sep. 12, 2019

(65) Prior Publication Data

US 2020/0286385 A1 Sep. 10, 2020

(51) Int. Cl.
*G08G 1/16* (2006.01)
*G08G 1/0969* (2006.01)
*G08G 1/0962* (2006.01)

(52) U.S. Cl.
CPC ..... *G08G 1/167* (2013.01); *G08G 1/0969* (2013.01); *G08G 1/09626* (2013.01); *G08G 1/166* (2013.01)

(58) Field of Classification Search
CPC ..... B60W 30/08; B60W 30/12; B60W 30/18; B60W 50/00; B60W 50/08; B60W 50/085;
(Continued)

(56) References Cited

U.S. PATENT DOCUMENTS

2009/0265061 A1* 10/2009 Watanabe ..... G08G 1/165 701/36
2016/0082971 A1* 3/2016 Fuehrer ..... B60W 50/14 701/48
(Continued)

FOREIGN PATENT DOCUMENTS

JP 10-281795 A 10/1998
JP 2001-134900 A 5/2001
(Continued)

OTHER PUBLICATIONS

International Search Report, issued in PCT/JP2018/008970, dated May 22, 2018.
(Continued)

*Primary Examiner* — Van T Trieu
(74) *Attorney, Agent, or Firm* — Birch, Stewart, Kolasch & Birch, LLP

(57) ABSTRACT

It is an object of the present invention to provide a driving assistance apparatus. The driving assistance apparatus according to the present invention includes: a subject vehicle information acquisition unit to acquire subject vehicle information; a non-subject vehicle information acquisition unit to acquire non-subject vehicle information; an object generation unit to generate, based on the subject vehicle information and the non-subject vehicle information, a travel location object indicating at least one of a location where the subject vehicle is currently to travel and a location where the subject vehicle is currently not to travel when the subject vehicle merges or changes lanes from a lane in which the subject vehicle travels to a lane in which the non-subject vehicle travels; and a display controller to perform control to display, in accordance with travel of the subject vehicle, the travel location object superimposed on scenery around the subject vehicle.

19 Claims, 36 Drawing Sheets

(58) Field of Classification Search
CPC ..... B60W 50/12; B60W 50/14; B62D 15/02; B62D 15/0255; G08G 1/166; G08G 1/167
See application file for complete search history.

(56) References Cited

U.S. PATENT DOCUMENTS

| | | | | |
|---|---|---|---|---|
| 2016/0300491 | A1 | 10/2016 | Fukuda et al. | |
| 2017/0106750 | A1 | 4/2017 | Tauchi et al. | |
| 2018/0148072 | A1* | 5/2018 | Kamiya | G06K 9/00832 |
| 2018/0194363 | A1 | 7/2018 | Sugiura et al. | |
| 2018/0326996 | A1* | 11/2018 | Fujisawa | B60W 50/085 |
| 2019/0061766 | A1* | 2/2019 | Nishiguchi | B60W 30/18163 |
| 2019/0071071 | A1* | 3/2019 | Yamada | B60W 50/14 |

FOREIGN PATENT DOCUMENTS

| | | | |
|---|---|---|---|
| JP | 2005-78414 | A | 3/2005 |
| JP | 2007-147317 | A | 6/2007 |
| JP | 2008-151507 | A | 7/2008 |
| JP | 2008-222153 | A | 9/2008 |
| JP | 2015-197706 | A | 11/2015 |
| JP | 2017-102739 | A | 6/2017 |
| WO | WO 2015/079623 | A1 | 6/2015 |

OTHER PUBLICATIONS

Japanese Office Action for Japanese Application No. 2020-504583, dated Mar. 9, 2021, with English translation.

* cited by examiner

DRIVING ASSISTANCE APPARATUS AND DRIVING ASSISTANCE METHOD

TECHNICAL FIELD

The present invention relates to a driving assistance apparatus and a driving assistance method to assist driving of a driver of a subject vehicle when the subject vehicle merges or changes lanes from a lane in which the subject vehicle travels to a lane in which a non-subject vehicle travels.

BACKGROUND ART

When a subject vehicle merges into an expressway and the like or changes lanes to an adjacent lane during travel, a driver of the subject vehicle is required to pay attention to movement of a non-subject vehicle traveling in a lane of a road into which the subject vehicle merges or in a lane to which the subject vehicle changes lanes.

Technology to identify a merging part to allow a subject vehicle to merge into a lane in which a non-subject vehicle travels, and present, to a driver, a location on a road surface at which steering is to be performed to allow the subject vehicle to merge into the merging part has been disclosed (see Patent Document 1, for example). Technology to present a merging point and time to reach the merging point to an occupant of a subject vehicle has also been disclosed (see Patent Document 2, for example).

PRIOR ART DOCUMENTS

Patent Documents

Patent Document 1: Japanese Patent Application Laid-Open No. 2008-151507

Patent Document 2: Japanese Patent Application Laid-Open No. 2017-102739

SUMMARY

Problem to be Solved by the Invention

When a subject vehicle merges or changes lanes, it is useful for a driver of the subject vehicle to know a location where the subject vehicle is currently to travel to allow the subject vehicle to smoothly merge or change lanes. Nevertheless, Patent Documents 1 and 2 are both silent on the location where the subject vehicle is currently to travel to allow the subject vehicle to smoothly merge in the merging part. Driving assistance to the driver when the subject vehicle merges or changes lanes thus has room for improvement.

The present invention has been conceived to solve such a problem, and it is an object of the present invention to provide a driving assistance apparatus and a driving assistance method allowing for appropriate driving assistance to a driver when a subject vehicle merges or changes lanes.

Means to Solve the Problem

To solve the above-mentioned problem, a driving assistance apparatus according to the present invention includes: a subject vehicle information acquisition unit to acquire subject vehicle information including a current location and a speed of a subject vehicle; a non-subject vehicle information acquisition unit to acquire non-subject vehicle information including a current location and a speed of a non-subject vehicle; an object generation unit to generate, based on the subject vehicle information acquired by the subject vehicle information acquisition unit and the non-subject vehicle information acquired by the non-subject vehicle information acquisition unit, a travel location object indicating at least one of a location where the subject vehicle is currently to travel and a location where the subject vehicle is currently not to travel when the subject vehicle merges or changes lanes from a lane in which the subject vehicle travels to a lane in which the non-subject vehicle travels; and a display controller to perform control to display, in accordance with travel of the subject vehicle, the travel location object generated by the object generation unit superimposed on scenery around the subject vehicle.

A driving assistance method according to the present invention includes: acquiring subject vehicle information including a current location and a speed of a subject vehicle; acquiring non-subject vehicle information including a current location and a speed of a non-subject vehicle; generating, based on the acquired subject vehicle information and the acquired non-subject vehicle information, a travel location object indicating at least one of a location where the subject vehicle is currently to travel and a location where the subject vehicle is currently not to travel when the subject vehicle merges or changes lanes from a lane in which the subject vehicle travels to a lane in which the non-subject vehicle travels; and performing control to display, in accordance with travel of the subject vehicle, the generated travel location object superimposed on scenery around the subject vehicle.

Effects of the Invention

According to the present invention, the driving assistance apparatus includes: the subject vehicle information acquisition unit to acquire the subject vehicle information including the current location and the speed of the subject vehicle; the non-subject vehicle information acquisition unit to acquire the non-subject vehicle information including the current location and the speed of the non-subject vehicle; the object generation unit to generate, based on the subject vehicle information acquired by the subject vehicle information acquisition unit and the non-subject vehicle information acquired by the non-subject vehicle information acquisition unit, the travel location object indicating at least one of the location where the subject vehicle is currently to travel and the location where the subject vehicle is currently not to travel when the subject vehicle merges or changes lanes from the lane in which the subject vehicle travels to the lane in which the non-subject vehicle travels; and the display controller to perform control to display, in accordance with the travel of the subject vehicle, the travel location object generated by the object generation unit superimposed on the scenery around the subject vehicle, allowing for appropriate driving assistance to a driver when the subject vehicle merges or changes lanes.

The driving assistance method includes: acquiring the subject vehicle information including the current location and the speed of the subject vehicle; acquiring the non-subject vehicle information including the current location and the speed of the non-subject vehicle; generating, based on the acquired subject vehicle information and the acquired non-subject vehicle information, the travel location object indicating at least one of the location where the subject vehicle is currently to travel and the location where the subject vehicle is currently not to travel when the subject vehicle merges or changes lanes from the lane in which the subject vehicle travels to the lane in which the non-subject vehicle travels; and performing control to display, in accordance with the travel of the subject vehicle, the generated travel location object superimposed on the scenery around the subject vehicle, allowing for appropriate driving assistance to the driver when the subject vehicle merges or changes lanes.

The objects, features, aspects, and advantages of the present invention will become more apparent from the following detailed description and the accompanying drawings.

DESCRIPTION OF EMBODIMENTS

Embodiments of the present invention will be described below based on the drawings.

Embodiment 1

<Configuration>

Figure 1:
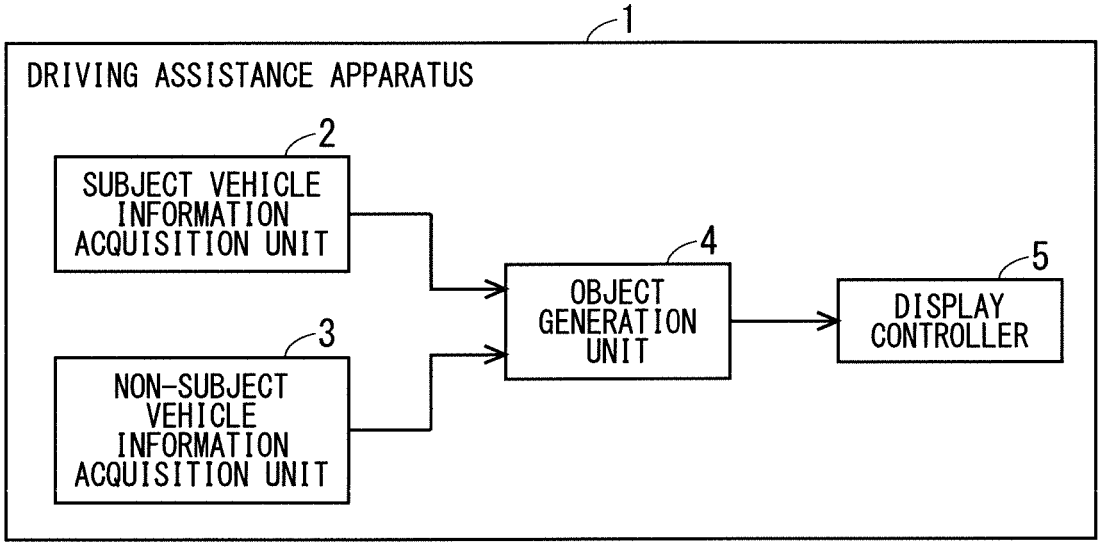
FIG. 1 is a block diagram showing one example of a configuration of a driving assistance apparatus according to Embodiment 1 of the present invention.

FIG. 1 is a block diagram showing one example of a configuration of a driving assistance apparatus 1 according to Embodiment 1 of the present invention. FIG. 1 shows minimum components necessary to constitute the driving assistance apparatus according to the present embodiment. Assume that the driving assistance apparatus 1 is installed in a subject vehicle.

As shown in FIG. 1, the driving assistance apparatus 1 includes a subject vehicle information acquisition unit 2, a non-subject vehicle information acquisition unit 3, an object generation unit 4, and a display controller 5. The subject vehicle information acquisition unit 2 acquires subject vehicle information including a current location and a speed of the subject vehicle. The non-subject vehicle information acquisition unit 3 acquires non-subject vehicle information including a current location and a speed of a non-subject vehicle. The object generation unit 4 generates, based on the subject vehicle information acquired by the subject vehicle information acquisition unit 2 and the non-subject vehicle information acquired by the non-subject vehicle information acquisition unit 3, a travel location object indicating at least one of a location where the subject vehicle is currently to travel and a location where the subject vehicle is currently not to travel when the subject vehicle merges or changes lanes from a lane in which the subject vehicle travels to a lane in which the non-subject vehicle travels. The display controller 5 performs control to display, in accordance with travel of the subject vehicle, the travel location object generated by the object generation unit 4 superimposed on scenery around the subject vehicle.

Merging and changing lanes will be described herein.

Figure 2:
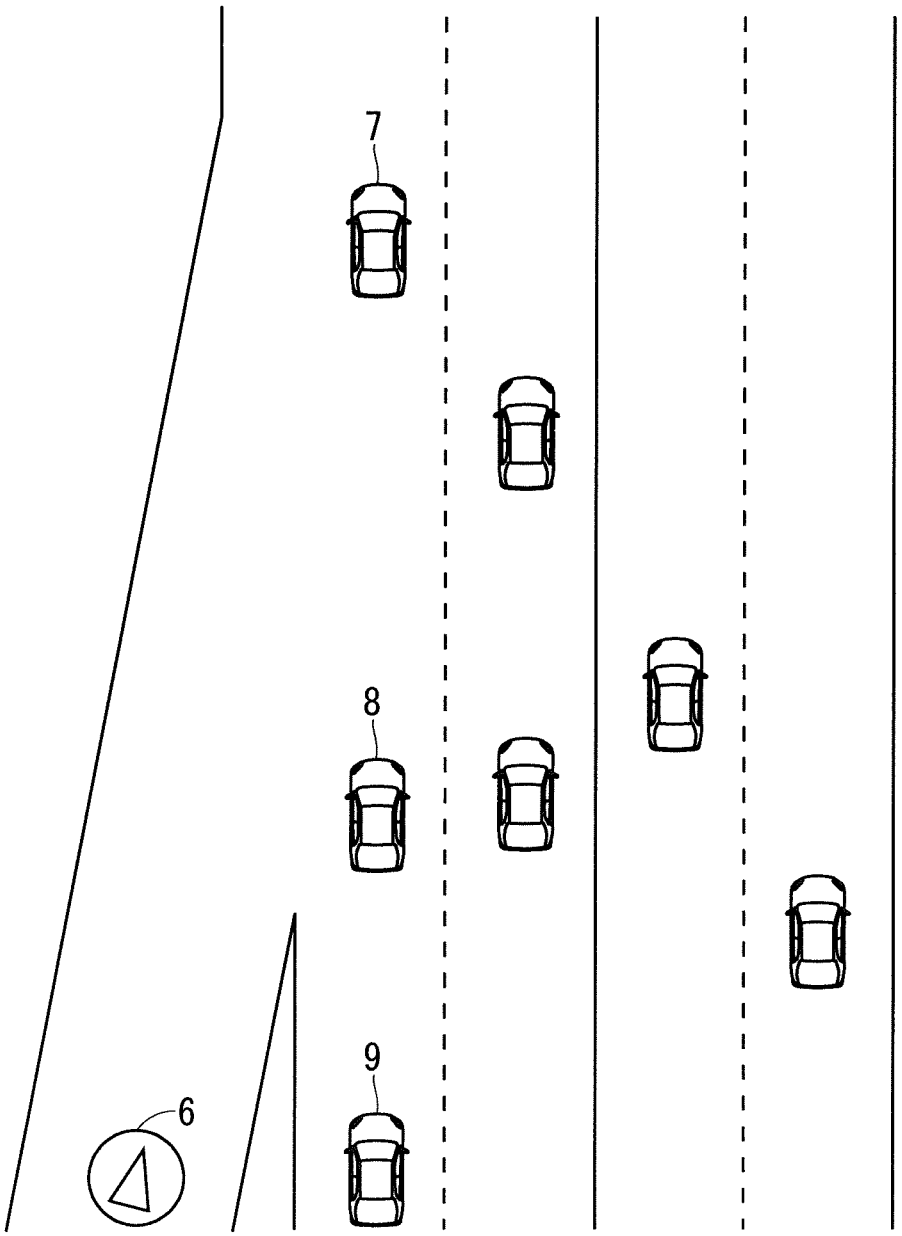
FIG. 2 illustrates one example of a state before merging according to Embodiment 1 of the present invention.
Figure 3:
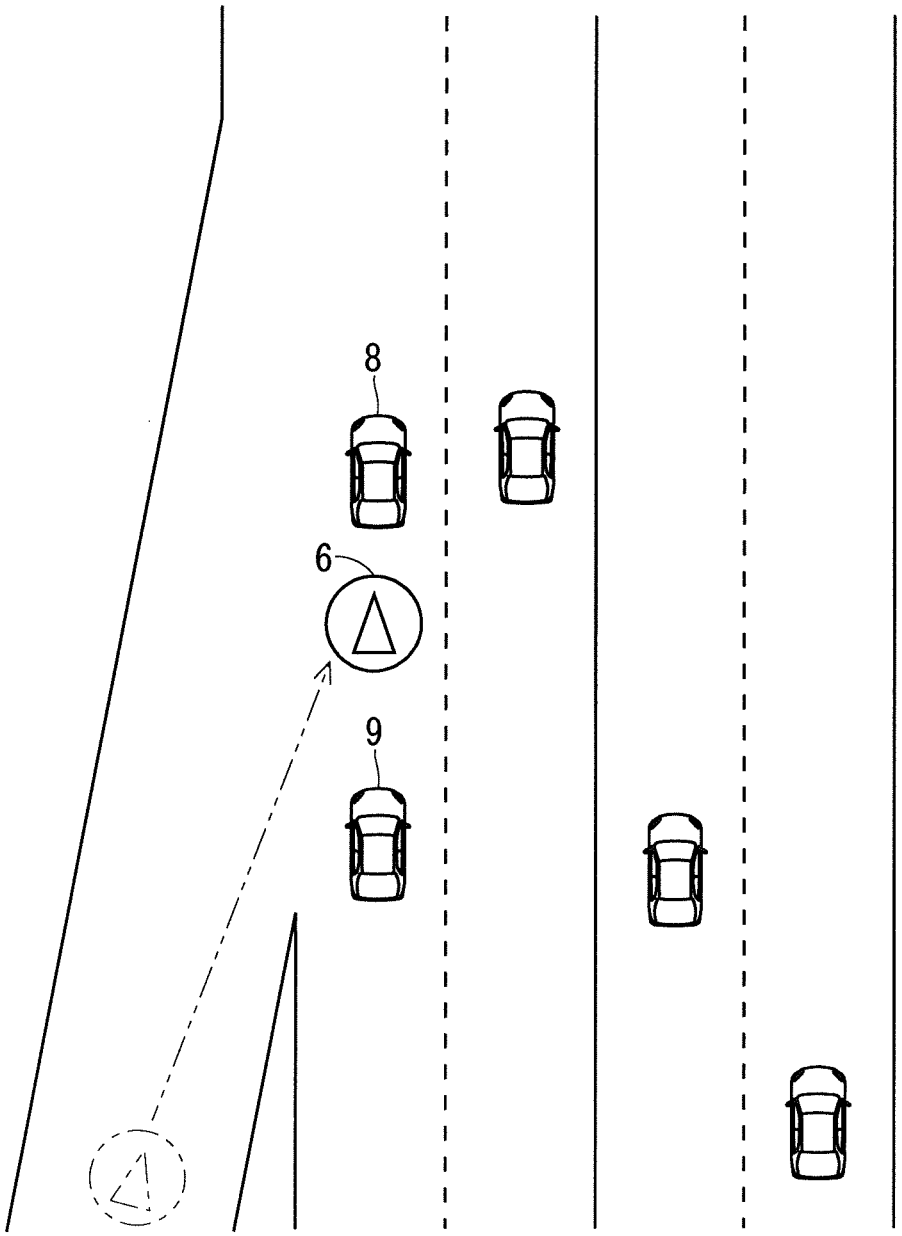
FIG. 3 illustrates one example of a state after merging according to Embodiment 1 of the present invention.

Merging refers to movement of a subject vehicle 6 from a lane in which the subject vehicle 6 travels to a lane in which non-subject vehicles 7 to 9 travel as illustrated in FIGS. 2 and 3, for example. In an example illustrated in FIGS. 2 and 3, the subject vehicle 6 merges from a ramp to the lane in which the non-subject vehicles 7 to 9 travel to be located between the non-subject vehicles 8 and 9. Changing lanes refers to movement of the subject vehicle from the lane in which the subject vehicle travels to an adjacent lane.

Another configuration of a driving assistance apparatus including the driving assistance apparatus 1 shown in FIG. 1 will be described next.

Figure 4:
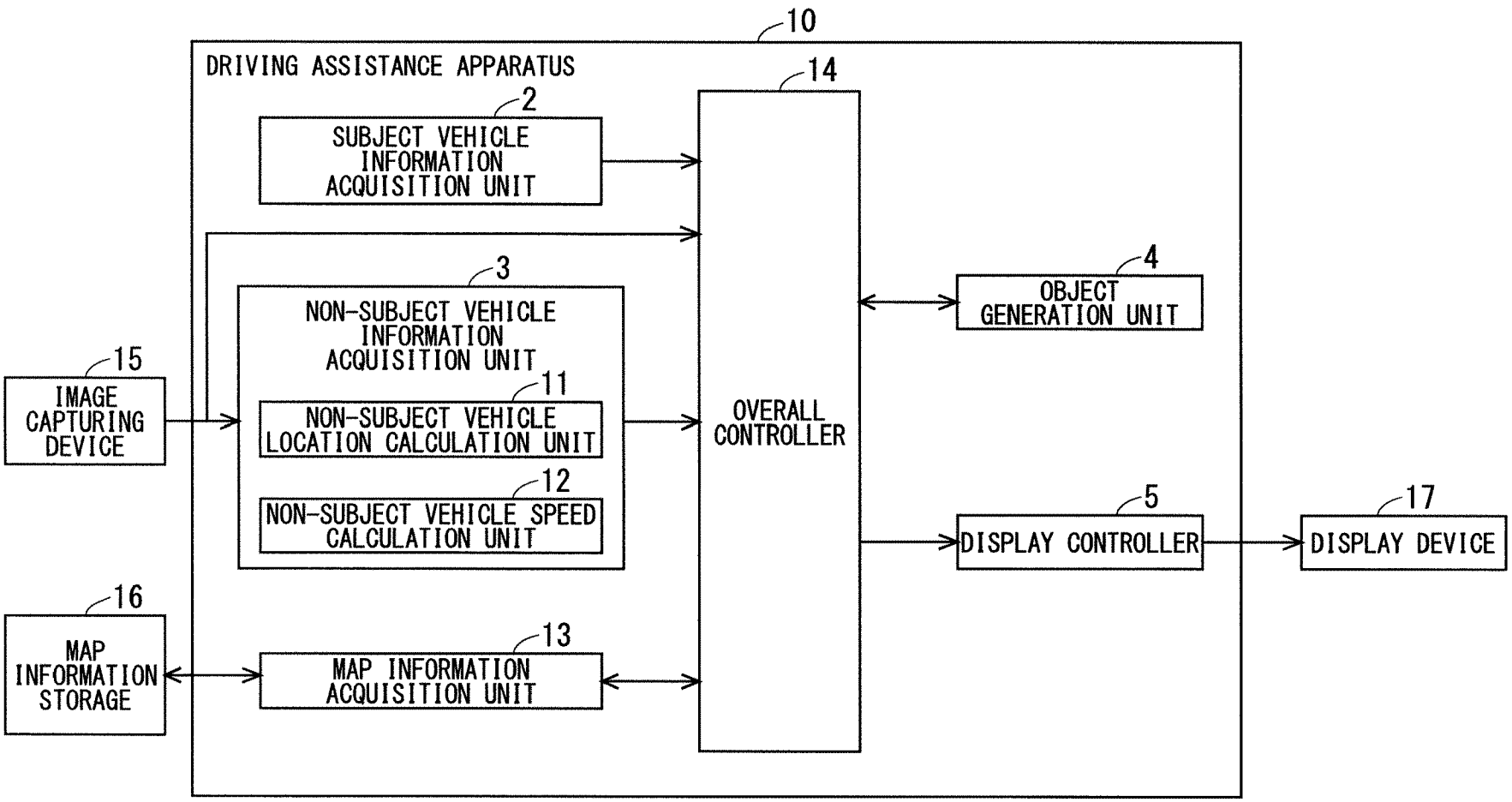
FIG. 4 is a block diagram showing one example of the configuration of the driving assistance apparatus according to Embodiment 1 of the present invention.

FIG. 4 is a block diagram showing one example of a configuration of a driving assistance apparatus 10 according to the other configuration.

As shown in FIG. 4, the driving assistance apparatus 10 includes the subject vehicle information acquisition unit 2, the non-subject vehicle information acquisition unit 3, the object generation unit 4, the display controller 5, a map information acquisition unit 13, and an overall controller 14. The non-subject vehicle information acquisition unit 3 and the overall controller 14 are connected to an image capturing device 15, the map information acquisition unit 13 is connected to a map information storage 16, and the display controller 5 is connected to a display device 17.

The subject vehicle information acquisition unit 2 acquires the subject vehicle information including the current location and the speed of the subject vehicle. The current location of the subject vehicle is, for example, an absolute location of the subject vehicle included in a global positioning system (GPS) signal. A more accurate current location of the subject vehicle may be acquired based on the absolute location of the subject vehicle included in the GPS signal and the speed, a movement distance, a steering direction, and the like of the subject vehicle. Assume that, in this case, information on the movement distance and the steering direction of the subject vehicle is included in the subject vehicle information acquired by the subject vehicle information acquisition unit 2.

The non-subject vehicle information acquisition unit 3 includes a non-subject vehicle location calculation unit 11 and a non-subject vehicle speed calculation unit 12. The non-subject vehicle location calculation unit 11 acquires an image captured by the image capturing device 15, and performs image processing on the image to calculate a location of the non-subject vehicle relative to the subject vehicle. The non-subject vehicle speed calculation unit 12 acquires the image captured by the image capturing device 15, and performs image processing on the image to calculate a speed of the non-subject vehicle relative to the subject vehicle. The image capturing device 15 is installed in the subject vehicle to capture an image around the subject vehicle. Specifically, the image capturing device 15 captures the image so that the image includes a lane in which the subject vehicle travels and a lane to which the subject vehicle merges or changes lanes.

A case described in an example of FIG. 4 is, but is not limited to, a case where image processing is performed on the image captured by the image capturing device 15 to calculate the relative location and speed of the non-subject vehicle. The non-subject vehicle information acquisition unit 3 may acquire information on an absolute location of the non-subject vehicle and information on a speed of the non-subject vehicle from the non-subject vehicle. In this case, the non-subject vehicle location calculation unit 11 and the non-subject vehicle speed calculation unit 12 are not required.

The map information acquisition unit 13 acquires, based on the current location of the subject vehicle acquired by the subject vehicle information acquisition unit 2, map information at least including lane information from the map information storage 16. The lane information includes information on line markings. The map information storage 16 is configured, for example, by a storage, such as a hard disk drive (HDD) and semiconductor memory, and stores the map information at least including the lane information. The map information storage 16 may be installed in the subject vehicle or external to the subject vehicle. The map information storage 16 may be included in the driving assistance apparatus 10.

The overall controller 14 calculates, based on the current location and the speed of the subject vehicle acquired by the subject vehicle information acquisition unit 2 and the current location and the speed of the non-subject vehicle acquired by the non-subject vehicle information acquisition unit 3, a point where the subject vehicle can merge or change lanes. The point where the subject vehicle can merge or change lanes can be calculated using known technology as disclosed in Patent Document 1, for example. The overall controller 14 also calculates at least one of the location where the subject vehicle is currently to travel and the location where the subject vehicle is currently not to travel to reach the point where the subject vehicle can merge or change lanes. Furthermore, the overall controller 14 can perform image processing on the image captured by the image capturing device 15 to detect line markings constituting the lane in which the subject vehicle travels.

The object generation unit 4 generates the travel location object indicating at least one of the location where the subject vehicle is currently to travel and the location where the subject vehicle is currently not to travel calculated by the overall controller 14. In this case, the object generation unit 4 determines the shape of the travel location object based on the image captured by the image capturing device 15.

The display controller 5 performs control to cause the display device 17 to display, in accordance with travel of the subject vehicle, the travel location object generated by the object generation unit 4 superimposed on the scenery around the subject vehicle. The display device 17 is, for example, a head up display (HUD), a monitor installed in an instrument panel, a monitor installed in a center console, or the like. In a case where the display device 17 is the HUD, for example, the display controller 5 performs control to display the travel location object superimposed on actual scenery seen through a windshield. In a case where the display device 17 is the monitor, for example, the display controller 5 performs control to display the travel location object superimposed on the image captured by the image capturing device 15.

Figure 5:
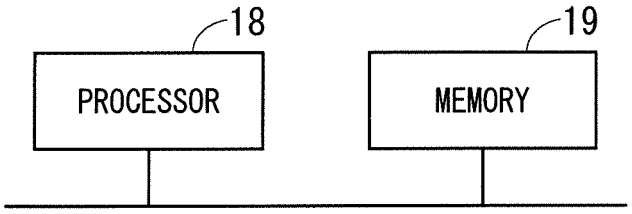
FIG. 5 is a block diagram showing one example of a hardware configuration of the driving assistance apparatus according to Embodiment 1 of the present invention.

FIG. 5 is a block diagram showing one example of a hardware configuration of the driving assistance apparatus 10. The same applies to the driving assistance apparatus 1 shown in FIG. 1.

Functions of the subject vehicle information acquisition unit 2, the non-subject vehicle information acquisition unit 3, the object generation unit 4, the display controller 5, the non-subject vehicle location calculation unit 11, the non-subject vehicle speed calculation unit 12, the map information acquisition unit 13, and the overall controller 14 included in the driving assistance apparatus 10 are each achieved by a processing circuit. That is to say, the driving assistance apparatus 10 includes the processing circuit to acquire the subject vehicle information, acquire the non-subject vehicle information, generate the object, perform control to display the object, calculate the location of the non-subject vehicle, calculate the speed of the non-subject vehicle, acquire the map information, calculate the point where the subject vehicle can merge or change lanes, calculate at least one of the location where the subject vehicle is currently to travel and the location where the subject vehicle is currently not to travel, and detect the line markings. The processing circuit is a processor 18 (also referred to as a central processing unit, a processing unit, an arithmetic unit, a microprocessor, a microcomputer, and a digital signal processor (DSP)) to execute a program stored in memory 19.

The functions of the subject vehicle information acquisition unit 2, the non-subject vehicle information acquisition unit 3, the object generation unit 4, the display controller 5, the non-subject vehicle location calculation unit 11, the non-subject vehicle speed calculation unit 12, the map information acquisition unit 13, and the overall controller 14 included in the driving assistance apparatus 10 are each achieved by software, firmware, or a combination of software and firmware. The software or the firmware is described as the program, and stored in the memory 19. The processing circuit reads and executes the program stored in the memory 19 to achieve each of the functions of the respective units. That is to say, the driving assistance apparatus 10 includes the memory 19 to store the program resulting in performance of steps including: acquiring the subject vehicle information; acquiring the non-subject vehicle information; generating the object; performing control to display the object; calculating the location of the non-subject vehicle; calculating the speed of the non-subject vehicle; acquiring the map information; calculating the point where the subject vehicle can merge or change lanes; calculating at least one of the location where the subject vehicle is currently to travel and the location where the subject vehicle is currently not to travel; and detecting the line markings. It can be said that the program is to cause a computer to execute procedures or methods of the subject vehicle information acquisition unit 2, the non-subject vehicle information acquisition unit 3, the object generation unit 4, the display controller 5, the non-subject vehicle location calculation unit 11, the non-subject vehicle speed calculation unit 12, the map information acquisition unit 13, and the overall controller 14. The memory herein may be, for example, nonvolatile or volatile semiconductor memory, such as random access memory (RAM), read only memory (ROM), flash memory, erasable programmable read only memory (EPROM), and electrically erasable programmable read only memory (EEPROM), a magnetic disk, a flexible disk, an optical disc, a compact disc, a mini disc, a DVD, and the like or any storage medium to be used in the future.

<Operation>

Figure 6:
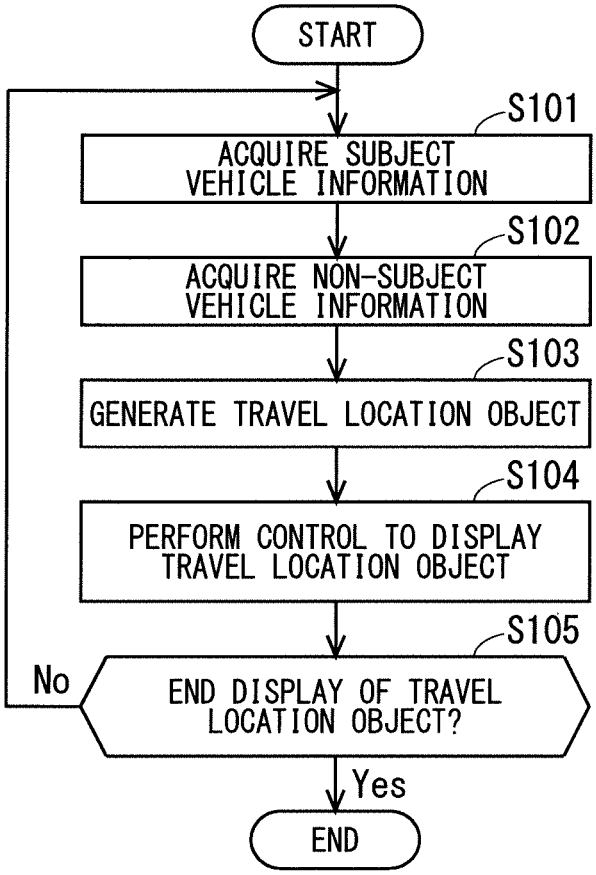
FIG. 6 is a flowchart showing one example of operation of the driving assistance apparatus according to Embodiment 1 of the present invention.

FIG. 6 is a flowchart showing one example of operation of the driving assistance apparatus 1 shown in FIG. 1.

In a step S101, the subject vehicle information acquisition unit 2 acquires the subject vehicle information including the current location and the speed of the subject vehicle.

In a step S102, the non-subject vehicle information acquisition unit 3 acquires the non-subject vehicle information including the current location and the speed of the non-subject vehicle.

In a step S103, the object generation unit 4 generates, based on the subject vehicle information acquired by the subject vehicle information acquisition unit 2 and the non-subject vehicle information acquired by the non-subject vehicle information acquisition unit 3, the travel location object indicating at least one of the location where the subject vehicle is currently to travel and the location where the subject vehicle is currently not to travel when the subject vehicle merges or changes lanes from the lane in which the subject vehicle travels to the lane in which the non-subject vehicle travels.

In a step S104, the display controller 5 performs control to display, in accordance with travel of the subject vehicle, the travel location object generated by the object generation unit 4 superimposed on the scenery around the subject vehicle.

In a step S105, the display controller 5 judges whether to end display of the travel location object. When display of the travel location object is ended, processing ends. On the other hand, when display of the travel location object is not ended, processing returns to the step S101.

Figure 7:
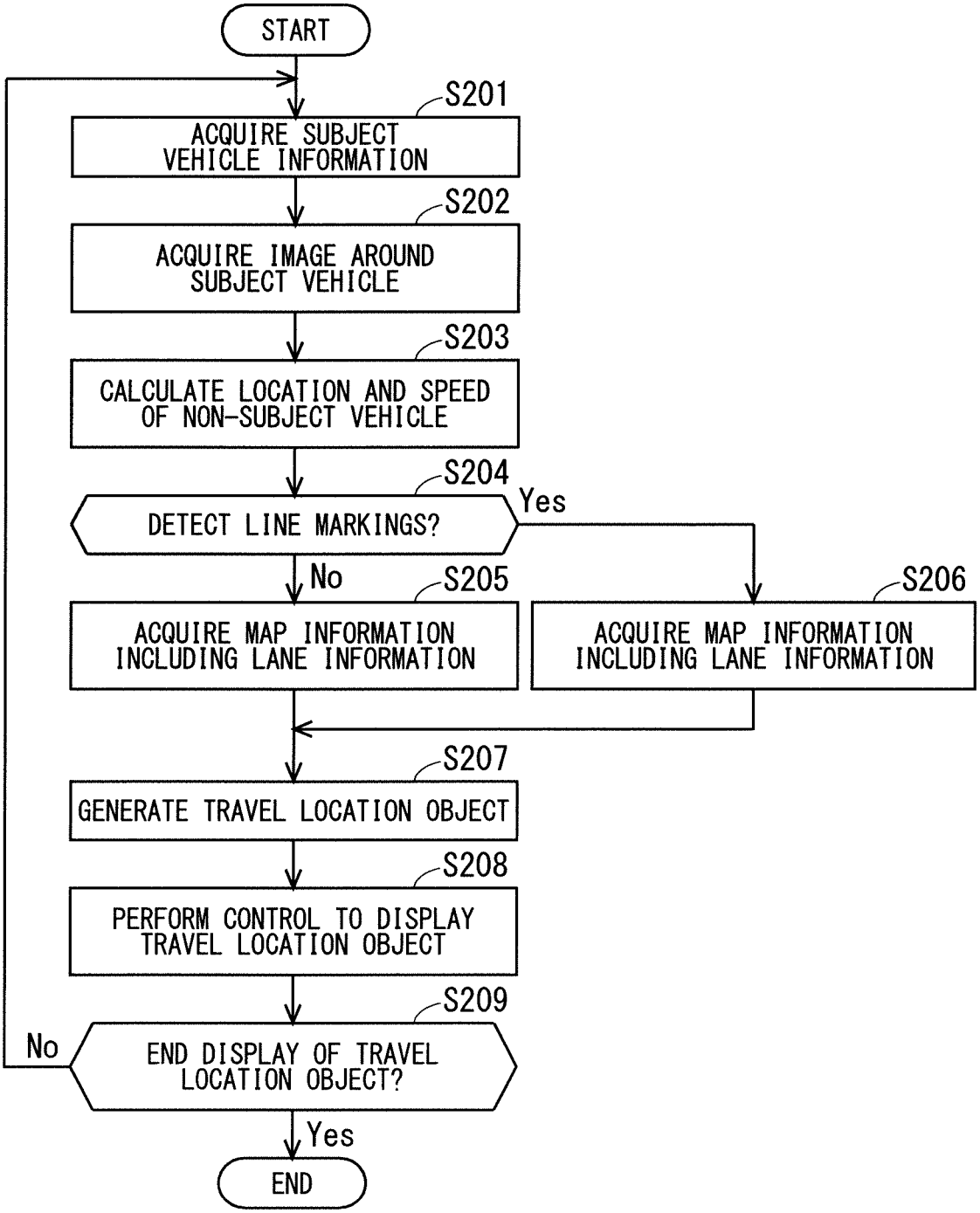
FIG. 7 is a flowchart showing one example of operation of the driving assistance apparatus according to Embodiment 1 of the present invention.

FIG. 7 is a flowchart showing one example of operation of the driving assistance apparatus 10 shown in FIG. 4.

In a step S201, the subject vehicle information acquisition unit 2 acquires the subject vehicle information including the current location and the speed of the subject vehicle.

In a step S202, the non-subject vehicle information acquisition unit 3 and the overall controller 14 each acquire the image around the subject vehicle captured by the image capturing device 15. The image around the subject vehicle includes the lane in which the subject vehicle travels and the lane to which the subject vehicle merges or changes lanes.

In a step S203, the non-subject vehicle location calculation unit 11 performs image processing on the image acquired from the image capturing device 15 to calculate the location of the non-subject vehicle relative to the subject vehicle. The non-subject vehicle speed calculation unit 12 performs image processing on the image acquired from the image capturing device 15 to calculate the speed of the non-subject vehicle relative to the subject vehicle.

In a step S204, the overall controller 14 performs image processing on the image acquired from the image capturing device 15 to judge whether the line markings constituting the lane in which the subject vehicle travels have been detected. When the line markings have not been detected, processing proceeds to a step S205. On the other hand, when the line markings have been detected, processing proceeds to a step S206.

In the step S205, the map information acquisition unit 13 acquires, based on the location of the subject vehicle, the map information including the lane information from the map information storage 16 in accordance with instructions of the overall controller 14.

In the step S206, the map information acquisition unit 13 acquires, based on the location of the subject vehicle, the map information including the lane information from the map information storage 16 in accordance with instructions of the overall controller 14. In this case, the line markings constituting the lane in which the subject vehicle travels are acquired from the line markings detected by the overall controller 14 from the image acquired from the image capturing device 15 and the line markings included in the lane information acquired from the map information storage 16, so that accuracy of detection of the line markings can further be improved. Processing in the step S206 may be omitted.

In a step S207, the object generation unit 4 generates the travel location object indicating at least one of the location where the subject vehicle is currently to travel and the location where the subject vehicle is currently not to travel calculated by the overall controller 14. In this case, the object generation unit 4 determines the shape of the travel location object based on the image captured by the image capturing device 15.

In a step S208, the display controller 5 performs control to cause the display device 17 to display, in accordance with travel of the subject vehicle, the travel location object generated by the object generation unit 4 superimposed on the scenery around the subject vehicle.

In a step S209, the overall controller 14 judges whether to end display of the travel location object. When display of the travel location object is ended, processing ends. On the other hand, when display of the travel location object is not ended, processing returns to the step S201.

<Display>

FIGS. 8 to 26 illustrate examples of display for driving assistance, and illustrate examples of display of the travel location object. FIGS. 8 to 26 each illustrate a case where the subject vehicle merges from the lane in which the subject vehicle travels to a lane in which a non-subject vehicle 21 travels, but the same applies to a case where the subject vehicle changes lanes. The display device 17 in each of FIGS. 8 to 26 is the HUD.

Figure 8:
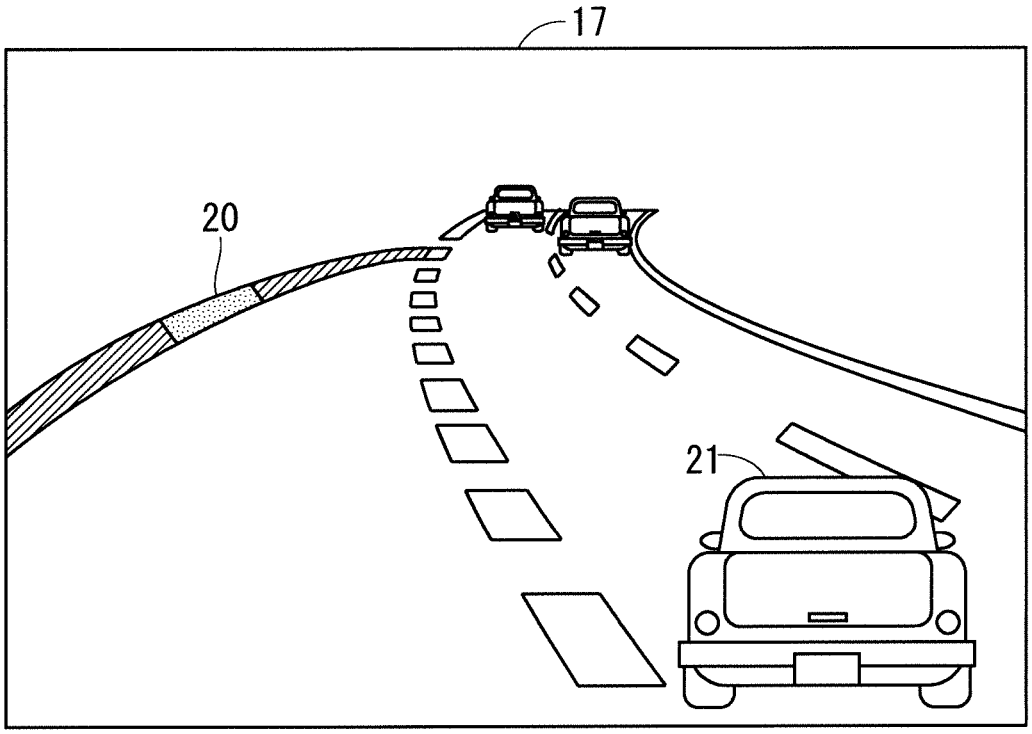
FIG. 8 illustrates one example of display for driving assistance according to Embodiment 1 of the present invention.

As illustrated in FIG. 8, the display device 17 displays a travel location object 20 superimposed on a left line marking from among the line markings constituting the lane in which the subject vehicle travels. A stippled area of the travel location object 20 indicates the location where the subject vehicle is currently to travel, and hatched areas of the travel location object 20 indicate the location where the subject vehicle is currently not to travel. That is to say, the location where the subject vehicle is currently to travel and the location where the subject vehicle is currently not to travel are displayed to be distinguished from each other. As illustrated in FIG. 8, the location where the subject vehicle is currently to travel is slightly ahead of the current location of the subject vehicle. A driver can thereby judge that it is necessary to accelerate the subject vehicle a little more. Although the travel location object 20 is superimposed on the line marking on the left of the subject vehicle in FIG. 8, the travel location object 20 may be superimposed on a line marking on the right of the subject vehicle, that is, a line marking located in a direction of merging.

Figure 9:
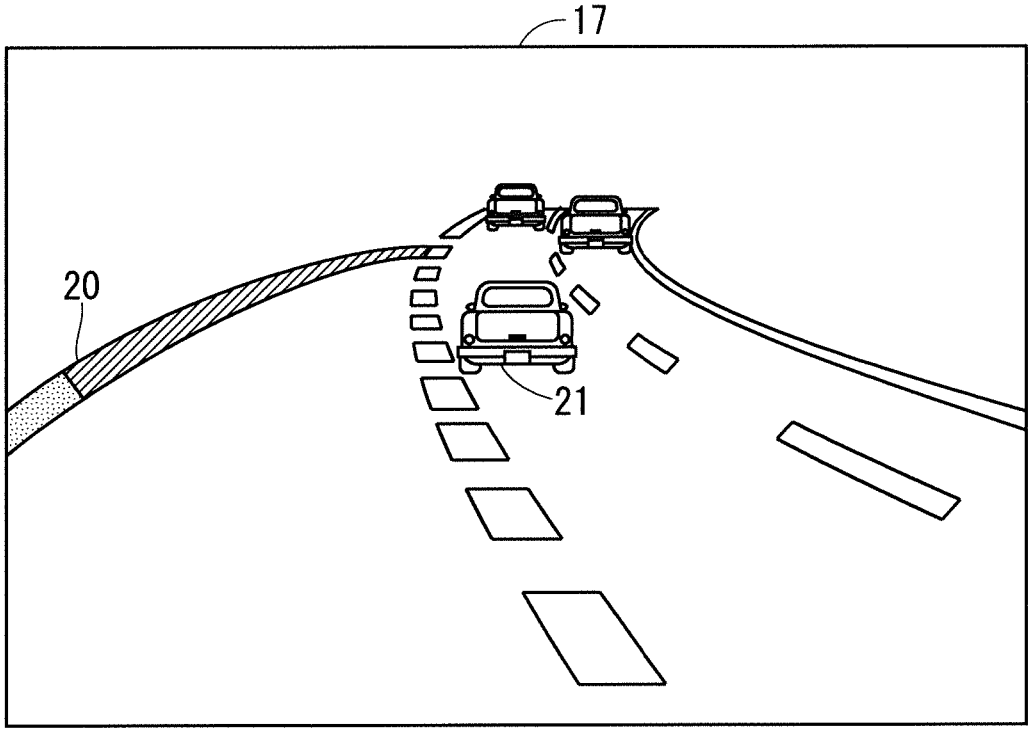
FIG. 9 illustrates one example of the display for driving assistance according to Embodiment 1 of the present invention.

In FIG. 9, the location where the subject vehicle is currently to travel is the current location of the subject vehicle. The other display is similar to that in FIG. 8. In this case, the driver can judge that it is only necessary to drive the subject vehicle at the current speed.

Figure 10:
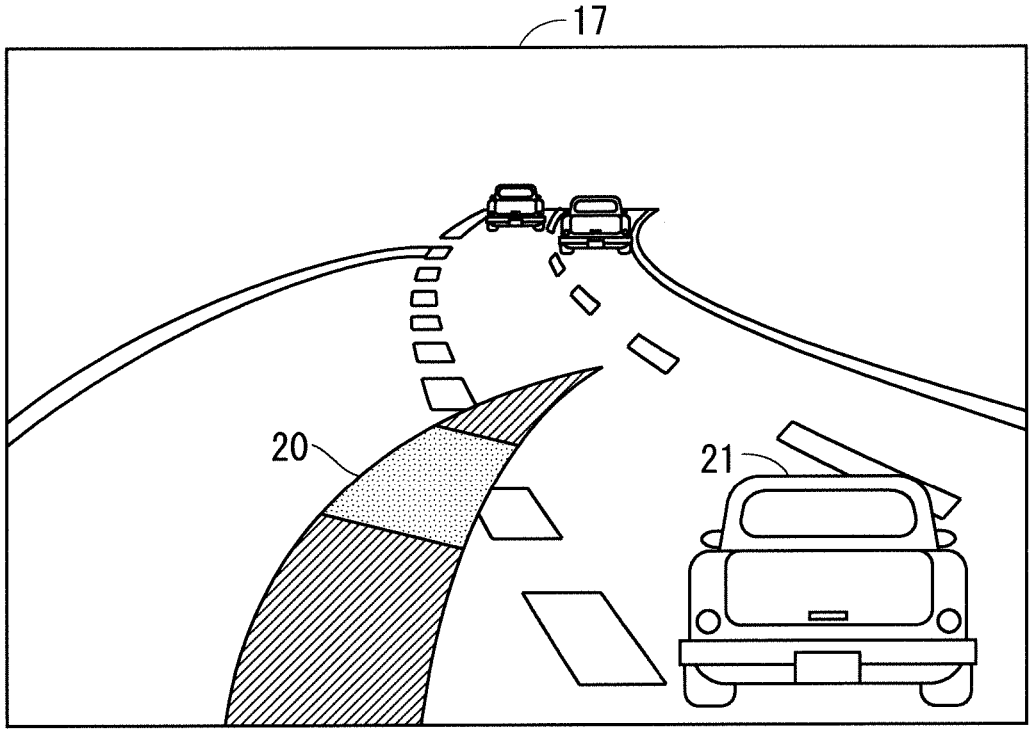
FIG. 10 illustrates one example of the display for driving assistance according to Embodiment 1 of the present invention.

As illustrated in FIG. 10, the display device 17 displays the travel location object 20 superimposed on the lane in which the subject vehicle travels. The travel location object 20 extends from the current location of the subject vehicle to a point where the subject vehicle can merge. The stippled area of the travel location object 20 indicates the location where the subject vehicle is currently to travel, and the hatched areas of the travel location object 20 indicate the location where the subject vehicle is currently not to travel. As illustrated in FIG. 10, the location where the subject vehicle is currently to travel is slightly ahead of the current location of the subject vehicle. The driver can thereby judge that it is necessary to accelerate the subject vehicle a little more.

Figure 11:
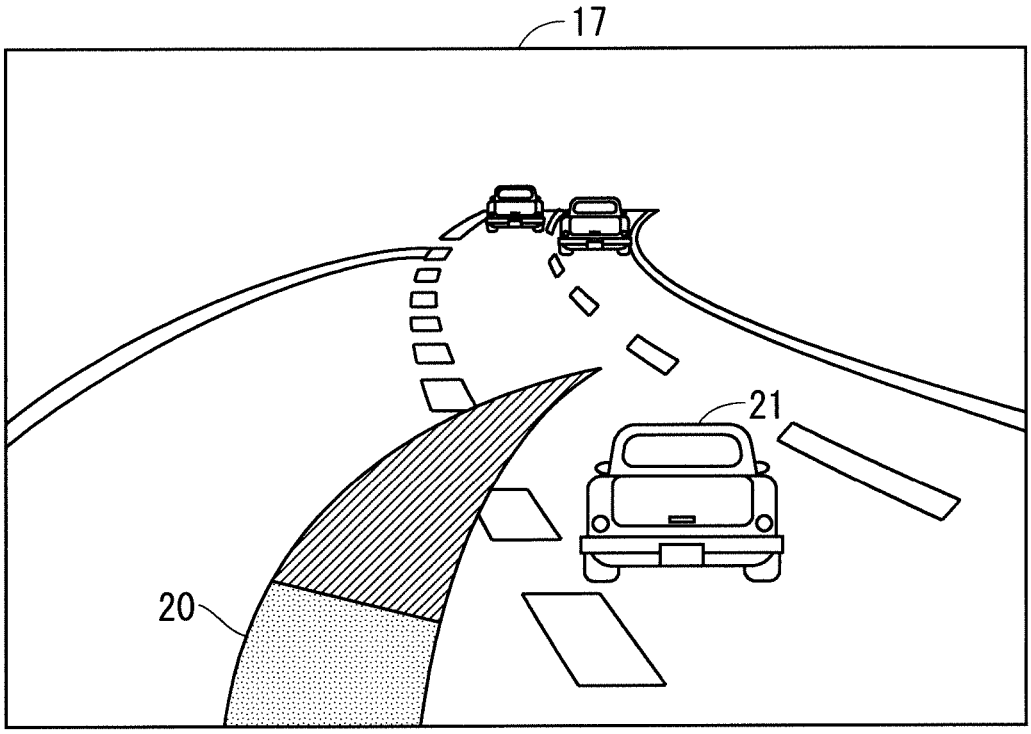
FIG. 11 illustrates one example of the display for driving assistance according to Embodiment 1 of the present invention.

In FIG. 11, the location where the subject vehicle is currently to travel is the current location of the subject vehicle. The other display is similar to that in FIG. 10. In this case, the driver can judge that it is only necessary to drive the subject vehicle at the current speed.

Figure 12:
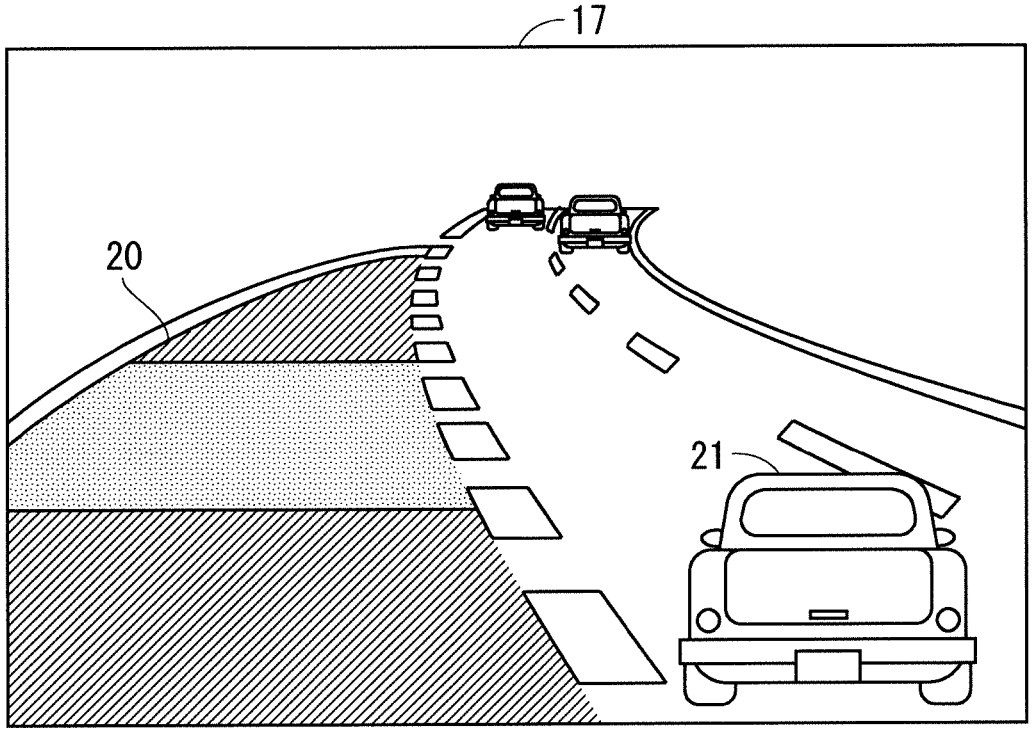
FIG. 12 illustrates one example of the display for driving assistance according to Embodiment 1 of the present invention.

As illustrated in FIG. 12, the display device 17 displays the travel location object 20 superimposed on the lane in which the subject vehicle travels as a whole. The stippled area of the travel location object 20 indicates the location where the subject vehicle is currently to travel, and the hatched areas of the travel location object 20 indicate the location where the subject vehicle is currently not to travel. As illustrated in FIG. 12, the location where the subject vehicle is currently to travel is slightly ahead of the current location of the subject vehicle. The driver can thereby judge that it is necessary to accelerate the subject vehicle a little more.

Figure 13:
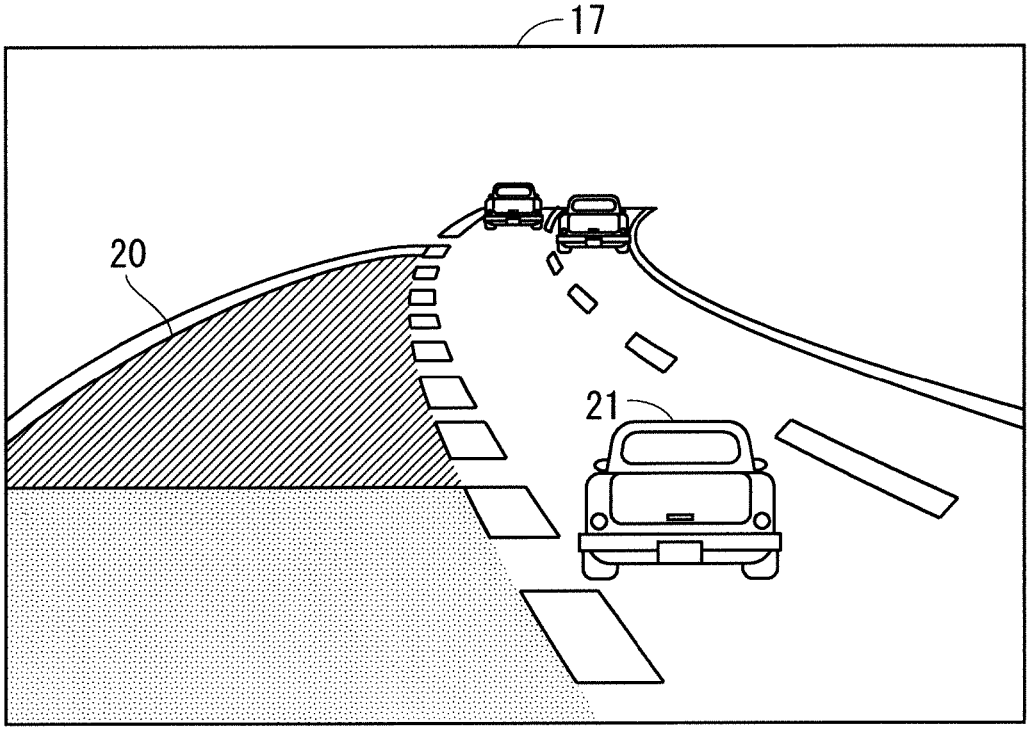
FIG. 13 illustrates one example of the display for driving assistance according to Embodiment 1 of the present invention.

In FIG. 13, the location where the subject vehicle is currently to travel is the current location of the subject vehicle. The other display is similar to that in FIG. 12. In this case, the driver can judge that it is only necessary to drive the subject vehicle at the current speed.

Figure 14:
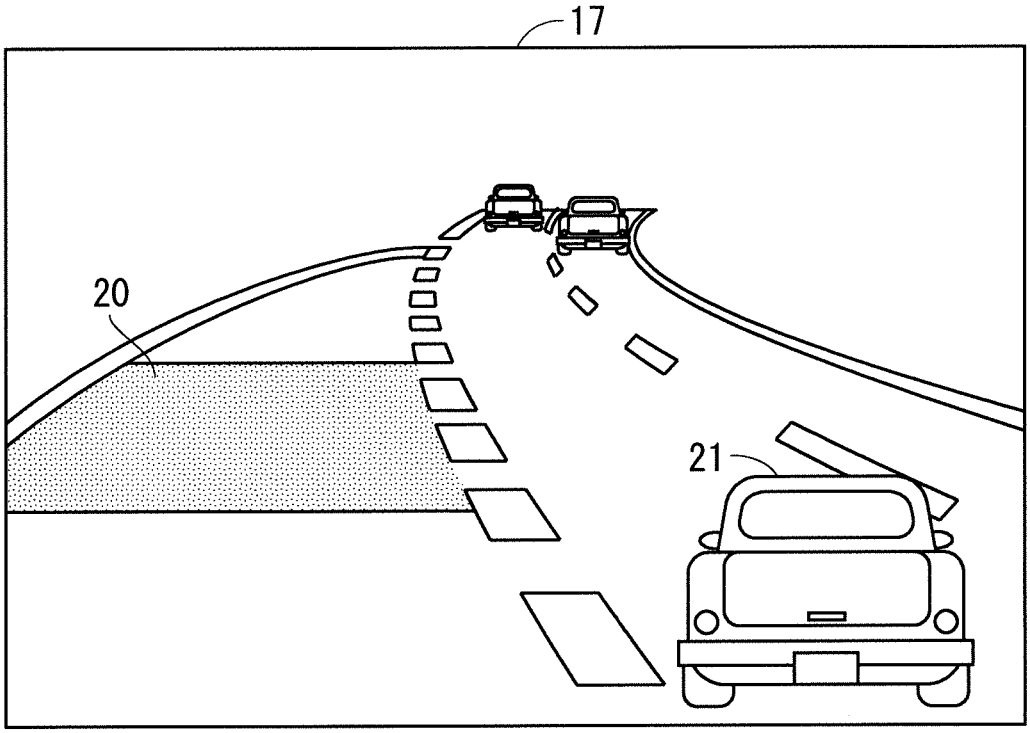
FIG. 14 illustrates one example of the display for driving assistance according to Embodiment 1 of the present invention.

As illustrated in FIG. 14, the display device 17 displays the travel location object 20 superimposed on the lane in which the subject vehicle travels as a whole. The travel location object 20 includes only the stippled area indicating the location where the subject vehicle is currently to travel. As illustrated in FIG. 14, the location where the subject vehicle is currently to travel is slightly ahead of the current location of the subject vehicle. The driver can thereby judge that it is necessary to accelerate the subject vehicle a little more.

Figure 15:
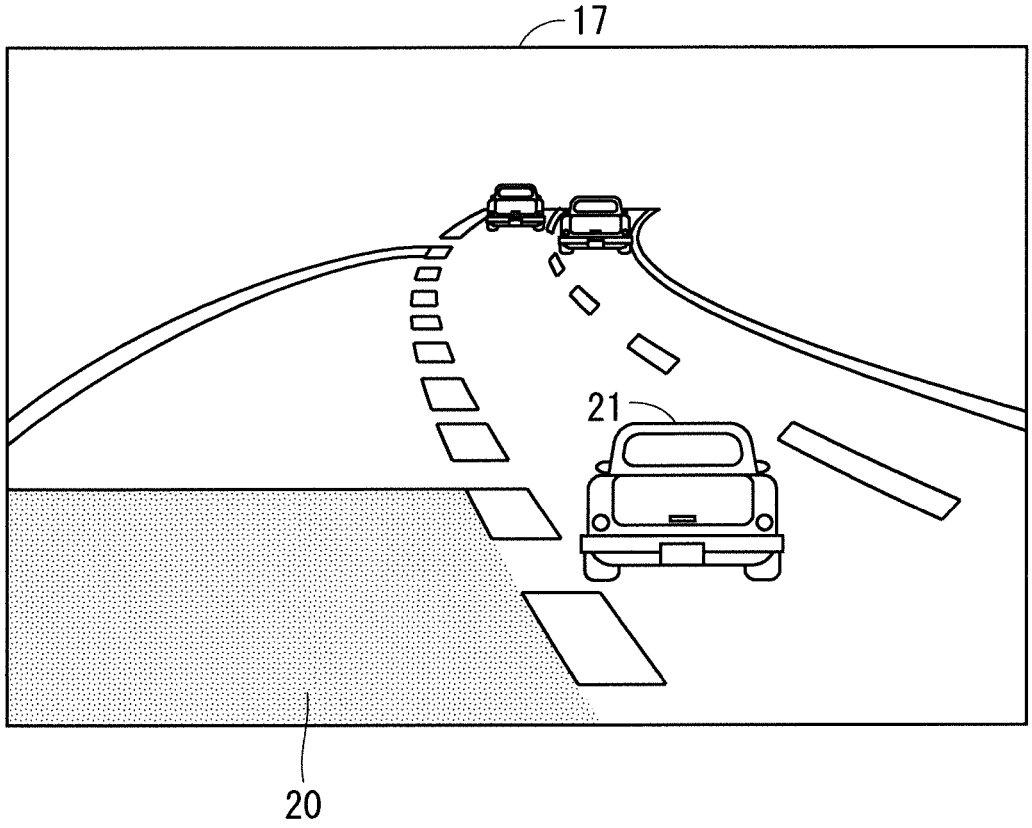
FIG. 15 illustrates one example of the display for driving assistance according to Embodiment 1 of the present invention.

In FIG. 15, the location where the subject vehicle is currently to travel is the current location of the subject vehicle. The other display is similar to that in FIG. 14. In this case, the driver can judge that it is only necessary to drive the subject vehicle at the current speed.

Figure 16:
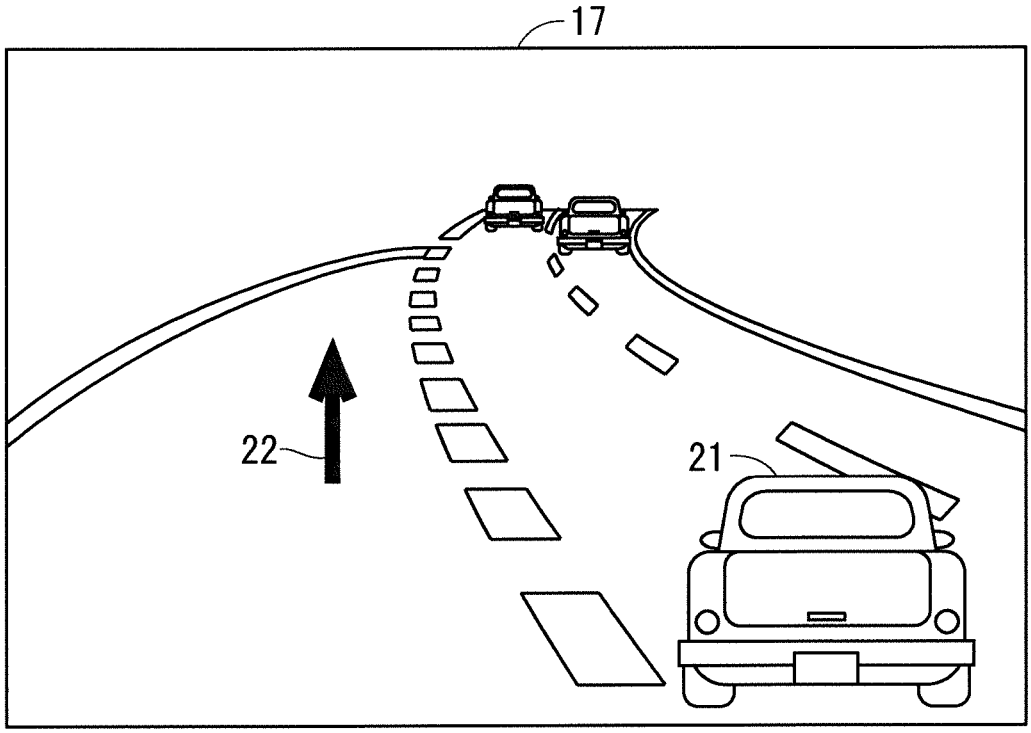
FIG. 16 illustrates one example of the display for driving assistance according to Embodiment 1 of the present invention.

As illustrated in FIG. 16, the display device 17 displays an acceleration and deceleration object 22 superimposed on the lane in which the subject vehicle travels. The acceleration and deceleration object 22 is an object indicating that the subject vehicle is currently to be accelerated or decelerated using characters or a symbol. In FIG. 16, the head of an arrow as the acceleration and deceleration object 22 points to the location where the subject vehicle is currently to travel. The acceleration and deceleration object 22 may blink. As illustrated in FIG. 16, the location where the subject vehicle is currently to travel is slightly ahead of the current location of the subject vehicle. The driver can thereby judge that it is necessary to accelerate the subject vehicle a little more.

Figure 17:
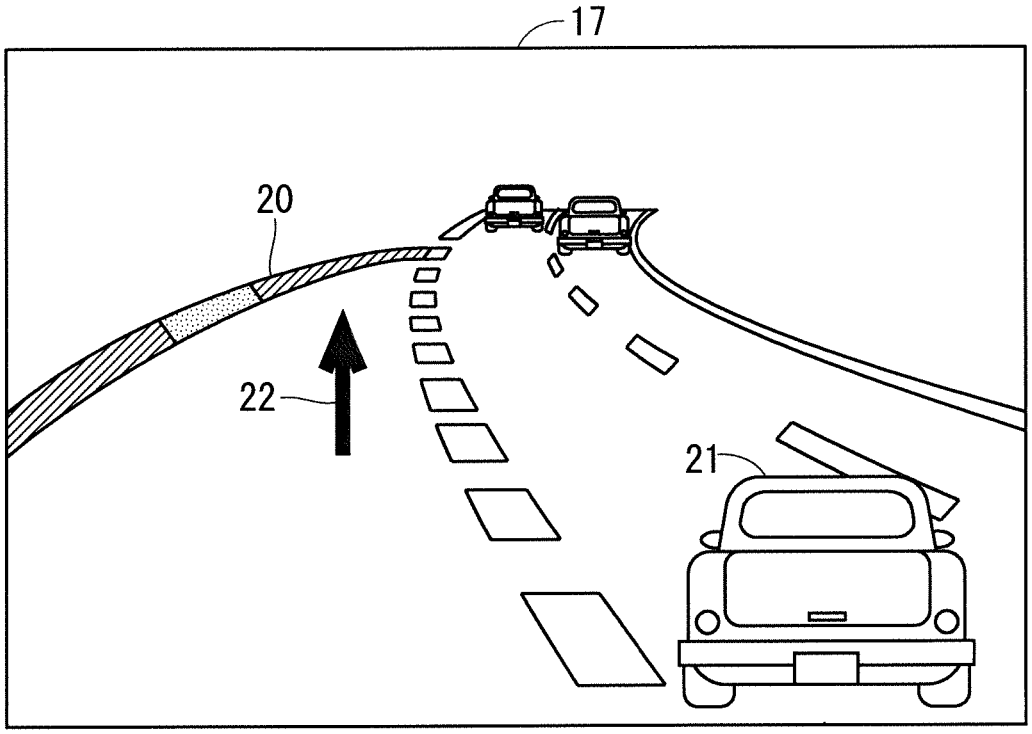
FIG. 17 illustrates one example of the display for driving assistance according to Embodiment 1 of the present invention.

As illustrated in FIG. 17, the display device 17 displays the travel location object 20 illustrated in FIG. 8 and the acceleration and deceleration object 22 illustrated in FIG. 16. The location where the subject vehicle is currently to travel in the travel location object 20 and the location of the head of the arrow as the acceleration and deceleration object 22 match each other in a direction of travel of the subject vehicle. The driver can thereby judge that it is necessary to accelerate the subject vehicle a little more.

Figure 18:
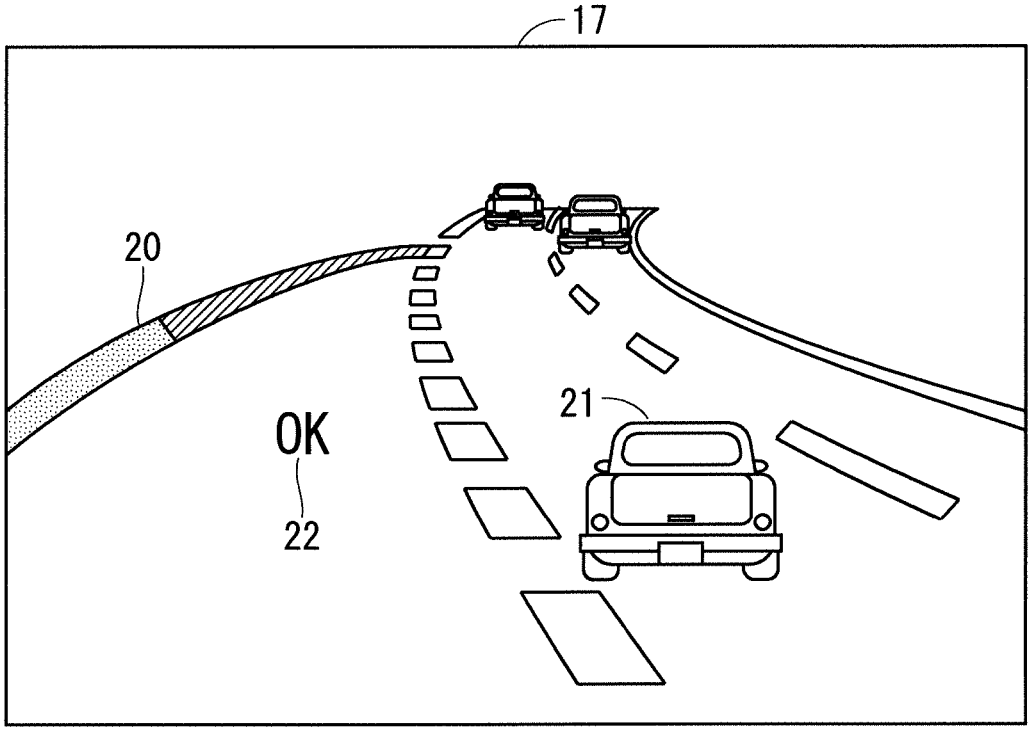
FIG. 18 illustrates one example of the display for driving assistance according to Embodiment 1 of the present invention.

As illustrated in FIG. 18, the display device 17 displays the travel location object 20 illustrated in FIG. 9 and the acceleration and deceleration object 22 represented by characters "OK". The driver can thereby judge that it is only necessary to drive the subject vehicle at the current speed.

Figure 19:
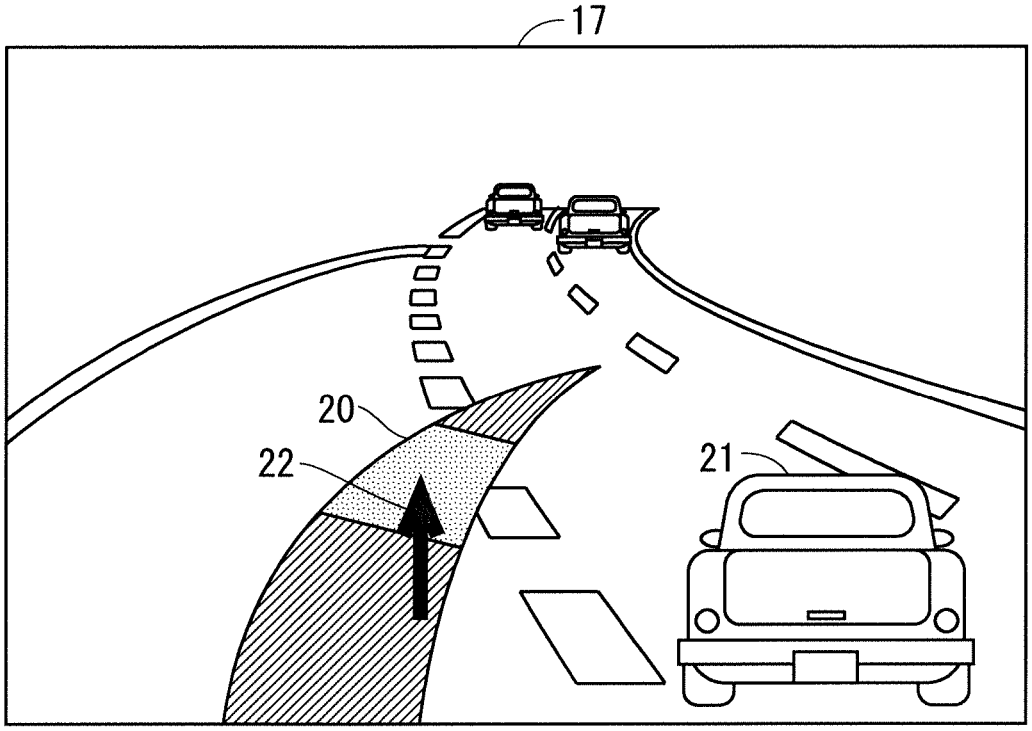
FIG. 19 illustrates one example of the display for driving assistance according to Embodiment 1 of the present invention.

As illustrated in FIG. 19, the display device 17 displays the travel location object 20 illustrated in FIG. 10 and the acceleration and deceleration object 22 illustrated in FIG. 16. The location where the subject vehicle is currently to travel in the travel location object 20 and the location of the head of the arrow as the acceleration and deceleration object 22 match each other in the direction of travel of the subject vehicle. The driver can thereby judge that it is necessary to accelerate the subject vehicle a little more.

Figure 20:
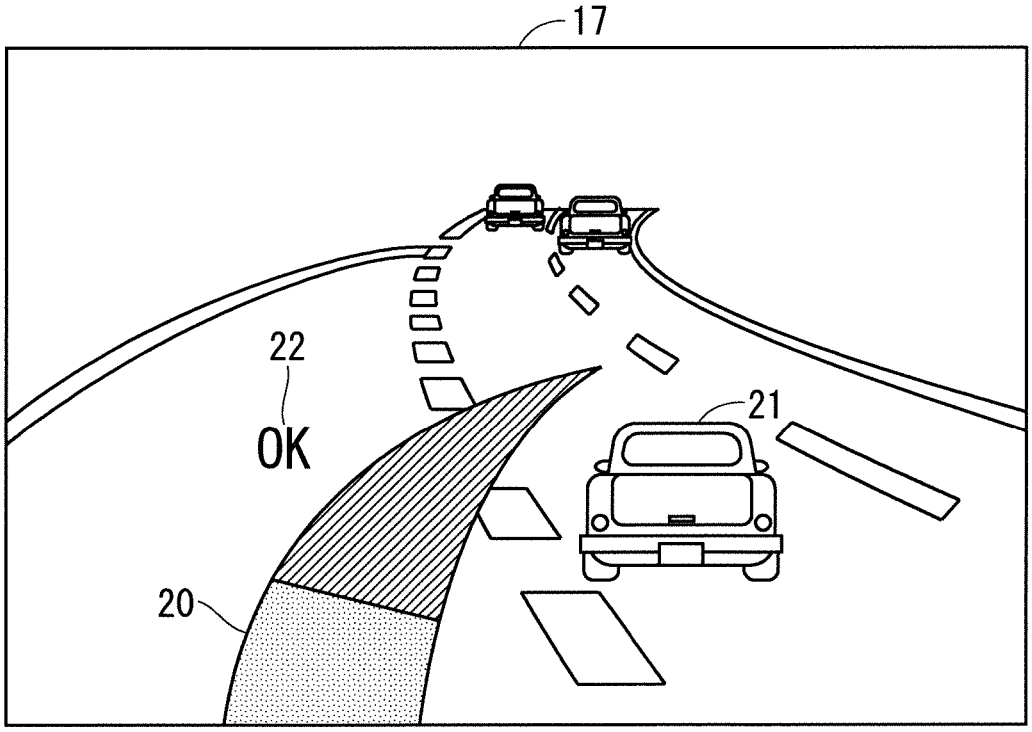
FIG. 20 illustrates one example of the display for driving assistance according to Embodiment 1 of the present invention.

As illustrated in FIG. 20, the display device 17 displays the travel location object 20 illustrated in FIG. 11 and the acceleration and deceleration object 22 represented by the characters "OK". The driver can thereby judge that it is only necessary to drive the subject vehicle at the current speed.

Figure 21:
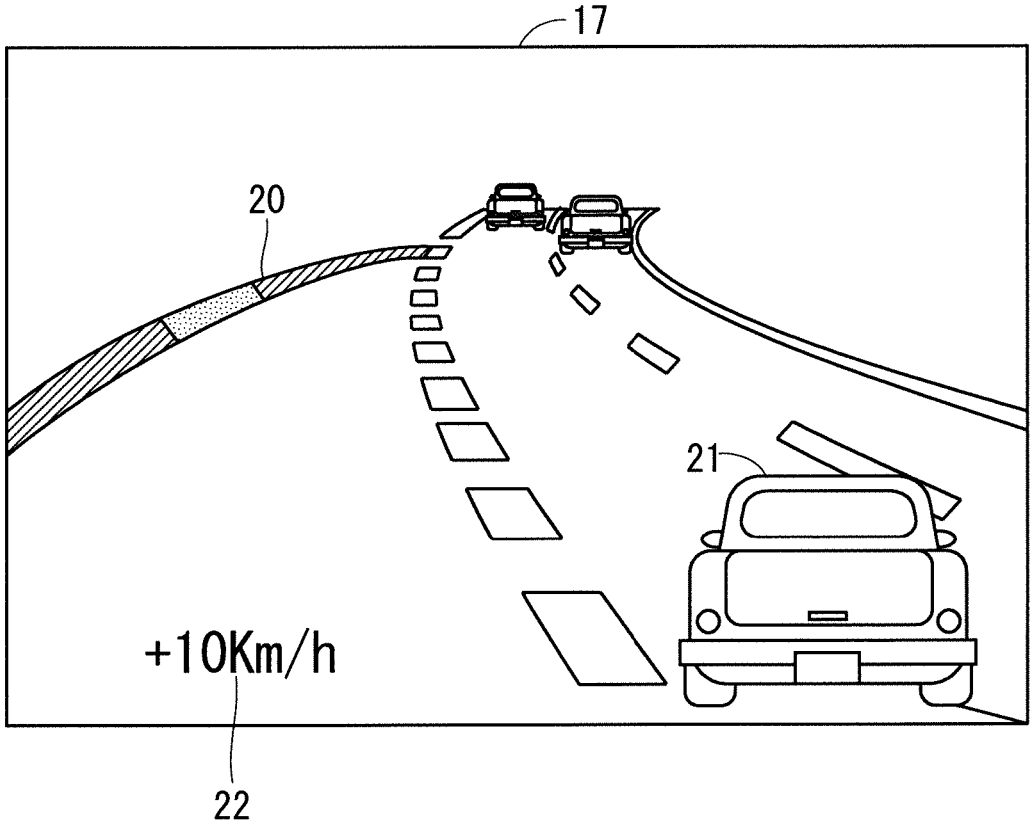
FIG. 21 illustrates one example of the display for driving assistance according to Embodiment 1 of the present invention.

As illustrated in FIG. 21, the display device 17 displays the travel location object 20 superimposed on the left line marking from among the line markings constituting the lane in which the subject vehicle travels and the acceleration and deceleration object 22 represented by characters "+10 Km/h". The stippled area of the travel location object 20 indicates the location where the subject vehicle is currently to travel, and the hatched areas of the travel location object 20 indicate the location where the subject vehicle is currently not to travel. The location where the subject vehicle is currently to travel is ahead of the current location of the subject vehicle. The driver can thereby judge that it is necessary to accelerate the subject vehicle by 10 Km/h from the current speed.

Figure 22:
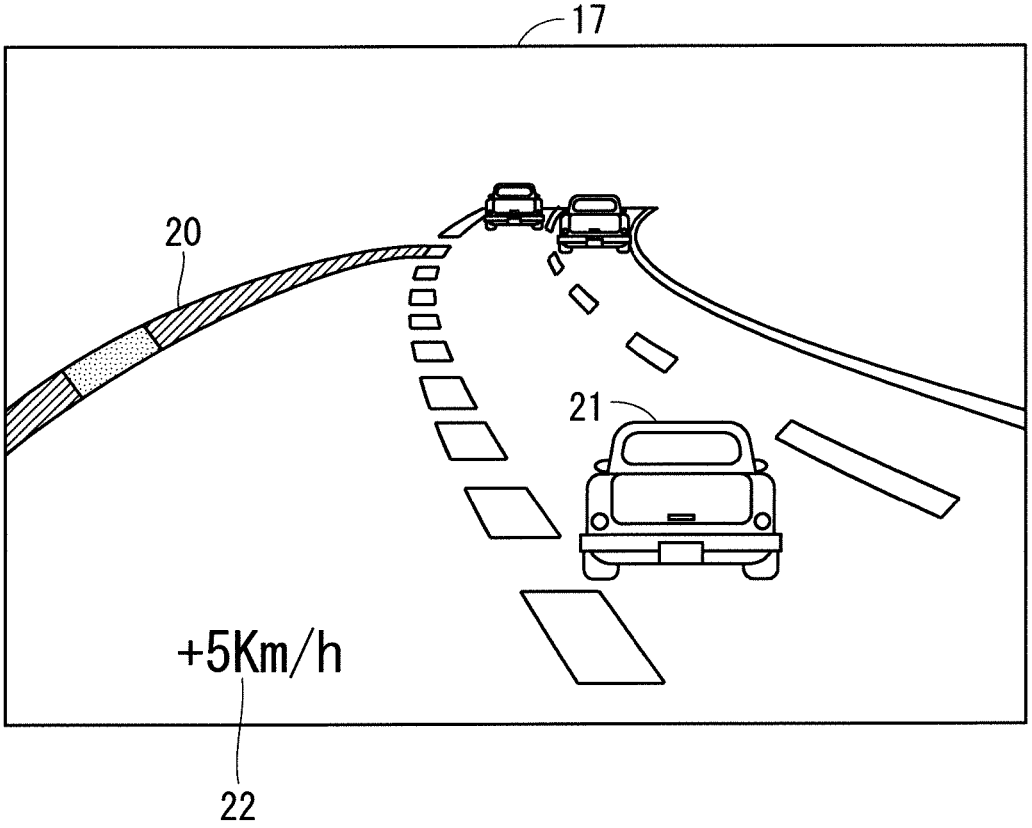
FIG. 22 illustrates one example of the display for driving assistance according to Embodiment 1 of the present invention.

As illustrated in FIG. 22, the display device 17 displays the travel location object 20 illustrated in FIG. 8 and the acceleration and deceleration object 22 represented by characters "+5 Km/h". The driver can thereby judge that it is necessary to accelerate the subject vehicle by 5 Km/h from the current speed.

Figure 23:
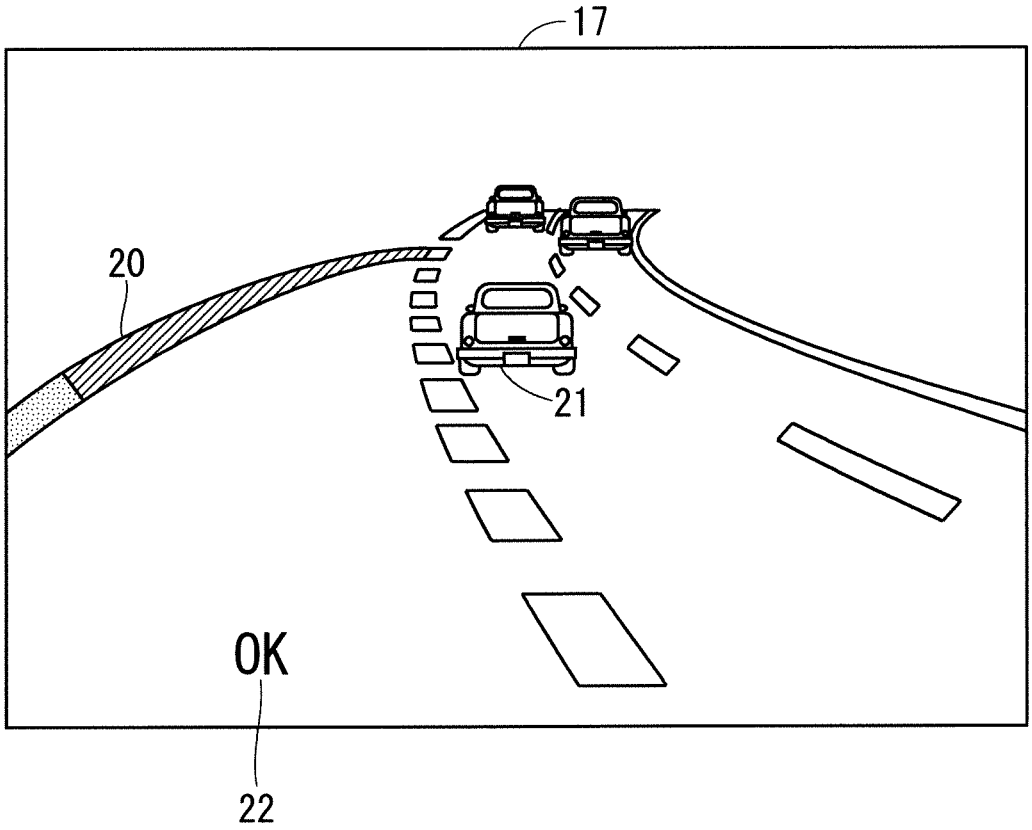
FIG. 23 illustrates one example of the display for driving assistance according to Embodiment 1 of the present invention.

As illustrated in FIG. 23, the display device 17 displays the travel location object 20 illustrated in FIG. 9 and the acceleration and deceleration object 22 represented by the characters "OK". The driver can thereby judge that it is only necessary to drive the subject vehicle at the current speed.

Figure 24:
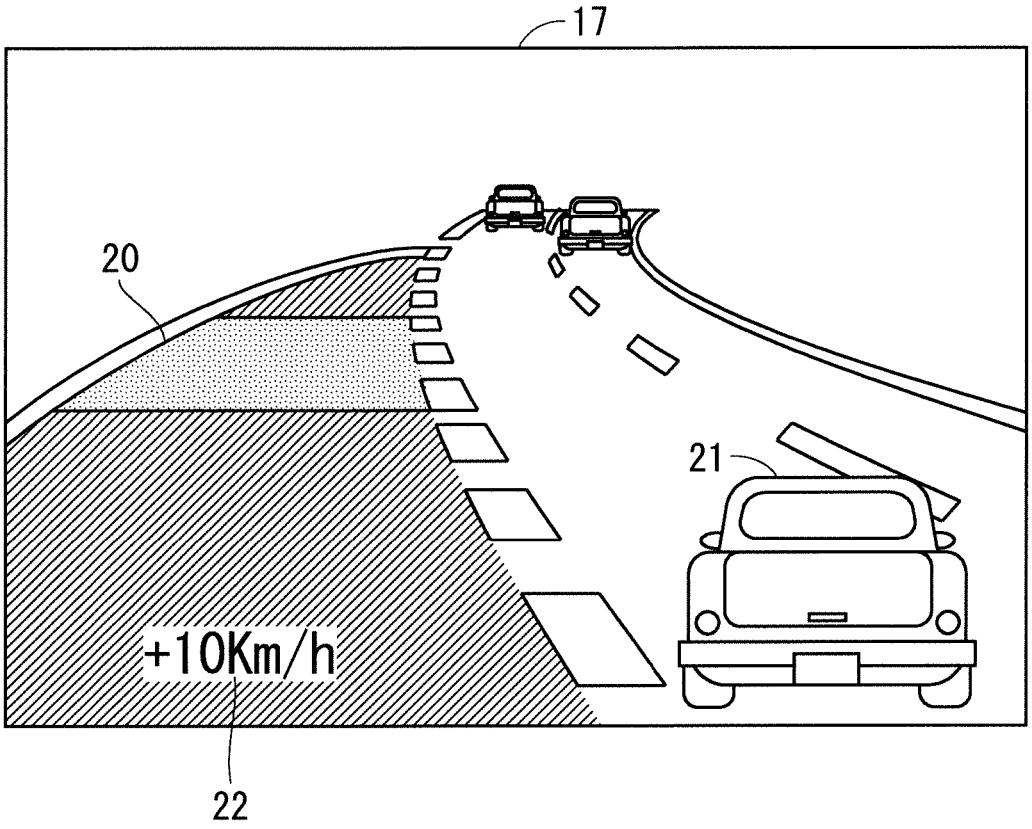
FIG. 24 illustrates one example of the display for driving assistance according to Embodiment 1 of the present invention.

As illustrated in FIG. 24, the display device 17 displays the travel location object 20 superimposed on the lane in which the subject vehicle travels as a whole and the acceleration and deceleration object 22 represented by the characters "+10 Km/h". The stippled area of the travel location object 20 indicates the location where the subject vehicle is currently to travel, and the hatched areas of the travel location object 20 indicate the location where the subject vehicle is currently not to travel. The location where the subject vehicle is currently to travel is ahead of the current location of the subject vehicle. The driver can thereby judge that it is necessary to accelerate the subject vehicle by 10 Km/h from the current speed.

Figure 25:
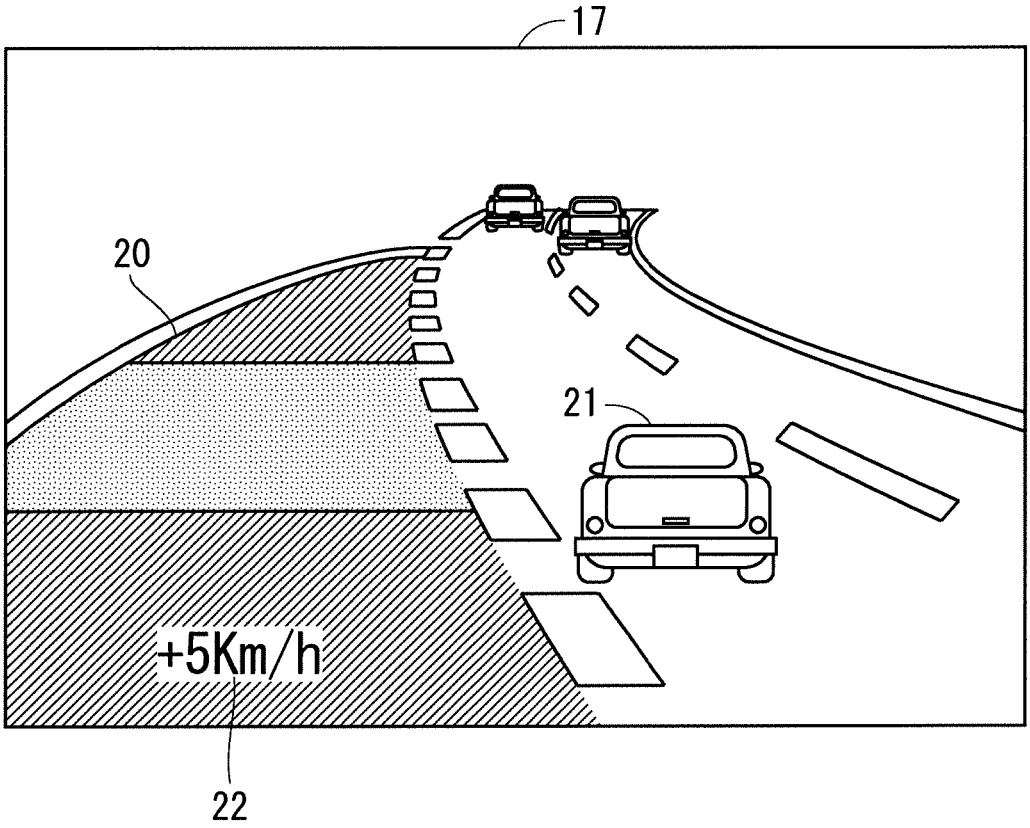
FIG. 25 illustrates one example of the display for driving assistance according to Embodiment 1 of the present invention.

As illustrated in FIG. 25, the display device 17 displays the travel location object 20 illustrated in FIG. 12 and the acceleration and deceleration object 22 represented by the characters "+5 Km/h". The driver can thereby judge that it is necessary to accelerate the subject vehicle by 5 Km/h from the current speed.

Figure 26:
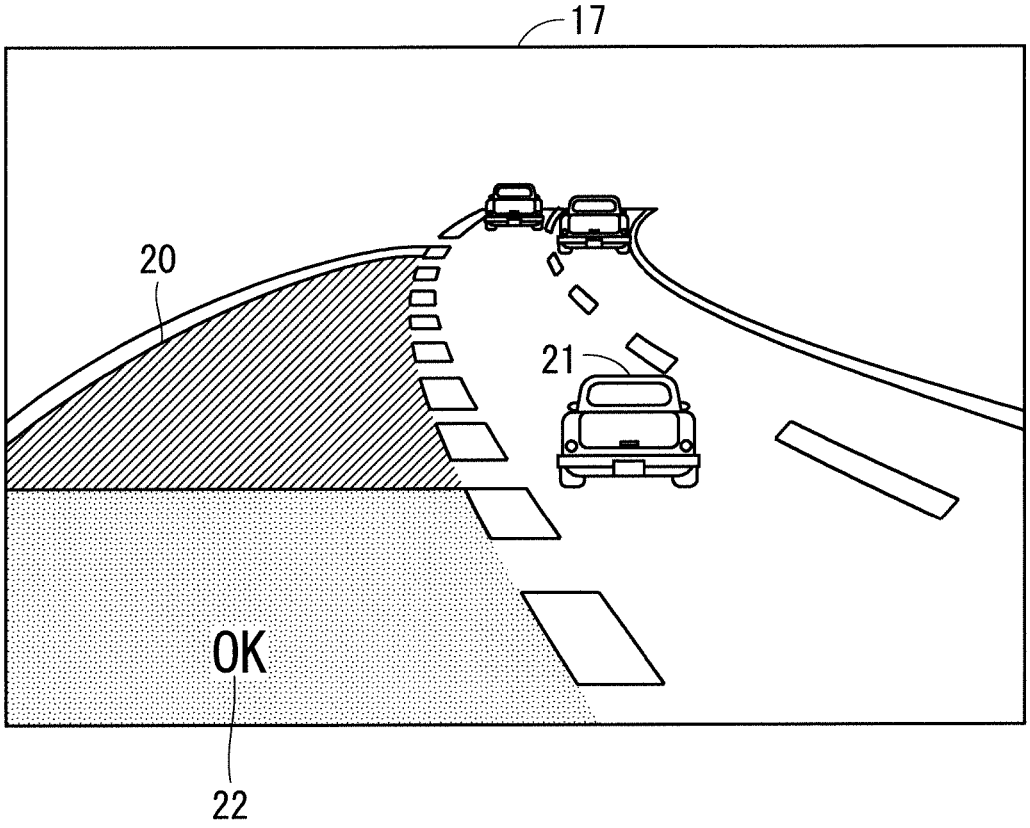
FIG. 26 illustrates one example of the display for driving assistance according to Embodiment 1 of the present invention.

As illustrated in FIG. 26, the display device 17 displays the travel location object 20 illustrated in FIG. 13 and the acceleration and deceleration object 22 represented by the characters "OK". The driver can thereby judge that it is only necessary to drive the subject vehicle at the current speed.

As described above, according to Embodiment 1, the display device 17 displays the location where the subject vehicle is currently to travel when the subject vehicle merges or changes lanes. This allows for appropriate driving assistance to the driver when the subject vehicle merges or changes lanes.

Embodiment 2

A configuration of a driving assistance apparatus according to Embodiment 2 of the present invention is similar to that of the driving assistance apparatus 10 according to Embodiment 1, and thus detailed description thereof is omitted herein.

Figure 27:
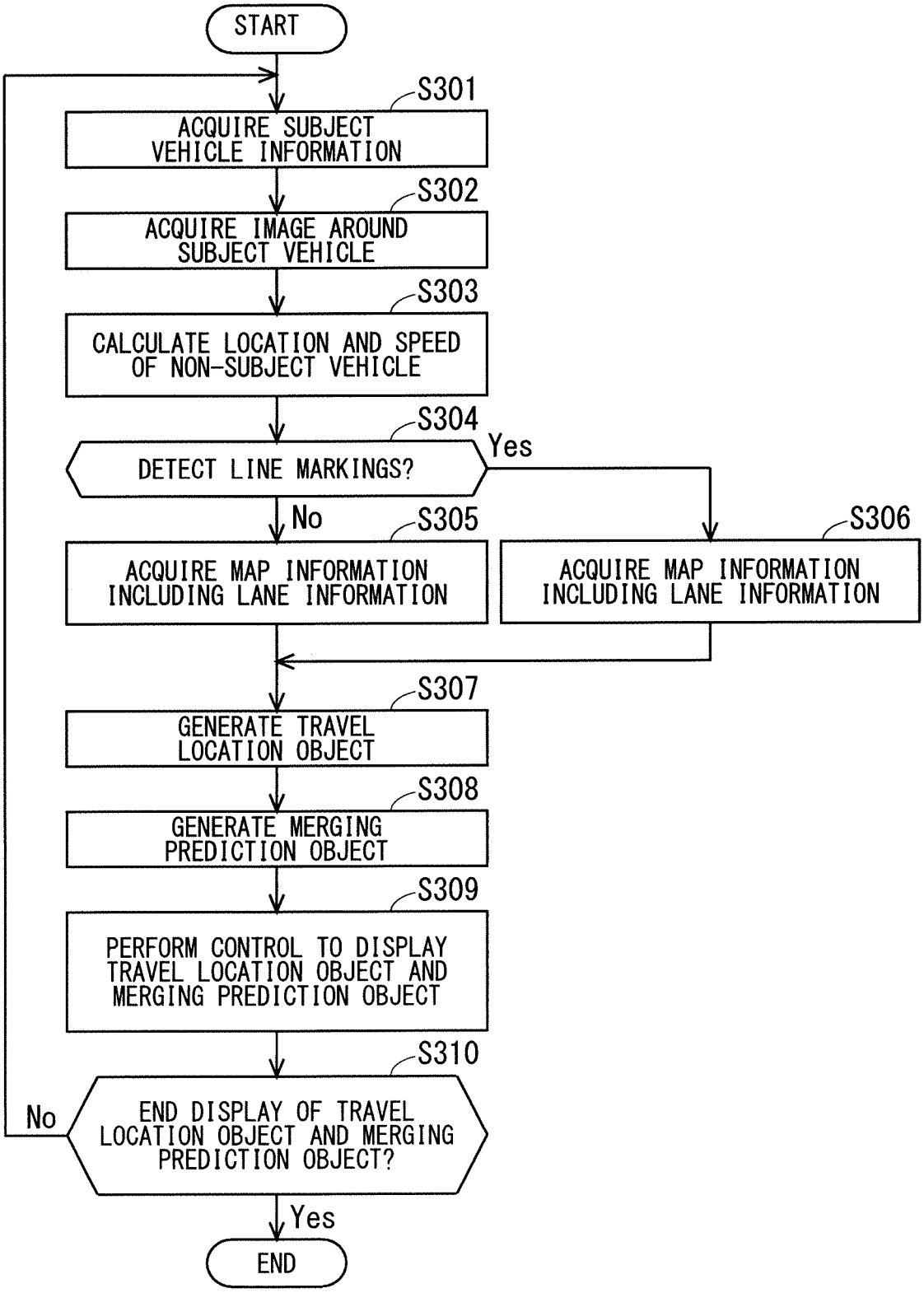
FIG. 27 is a flowchart showing one example of operation of a driving assistance apparatus according to Embodiment 2 of the present invention.

FIG. 27 is a flowchart showing one example of operation of the driving assistance apparatus according to Embodiment 2. Steps S301 to S306 in FIG. 27 respectively correspond to the steps S201 to S206 in FIG. 7, and thus description thereof is omitted herein. Steps S307 to S310 will be described below.

In the step S307, the object generation unit 4 generates a travel location object indicating a path from the current location of the subject vehicle to a point where the subject vehicle can merge calculated by the overall controller 14.

In the step S308, the object generation unit 4 generates a merging prediction object. Specifically, the overall controller 14 calculates a location that would become the location of the subject vehicle and a location that would become the location of the non-subject vehicle if the subject vehicle travels to a merging point at the current speed. The object generation unit 4 generates an object indicating an imaginary subject vehicle being the subject vehicle that is imaginary and an imaginary non-subject vehicle being the non-subject vehicle that is imaginary respectively at the location that would become the location of the subject vehicle and the location that would become the location of the non-subject vehicle if the subject vehicle travels to the merging point at the current speed. The object indicating the imaginary subject vehicle and the imaginary non-subject vehicle corresponds to the merging prediction object.

In the step S309, the display controller 5 performs control to cause the display device 17 to display, in accordance with travel of the subject vehicle, the travel location object generated by the object generation unit 4 in the step S307 and the merging prediction object generated by the object generation unit 4 in the step S308 superimposed on the scenery around the subject vehicle.

In the step S310, the overall controller 14 judges whether to end display of the travel location object and the merging prediction object. When display of the travel location object and the merging prediction object is ended, processing ends.

On the other hand, when display of the travel location object and the merging prediction object is not ended, processing returns to the step S301.

Figure 28:
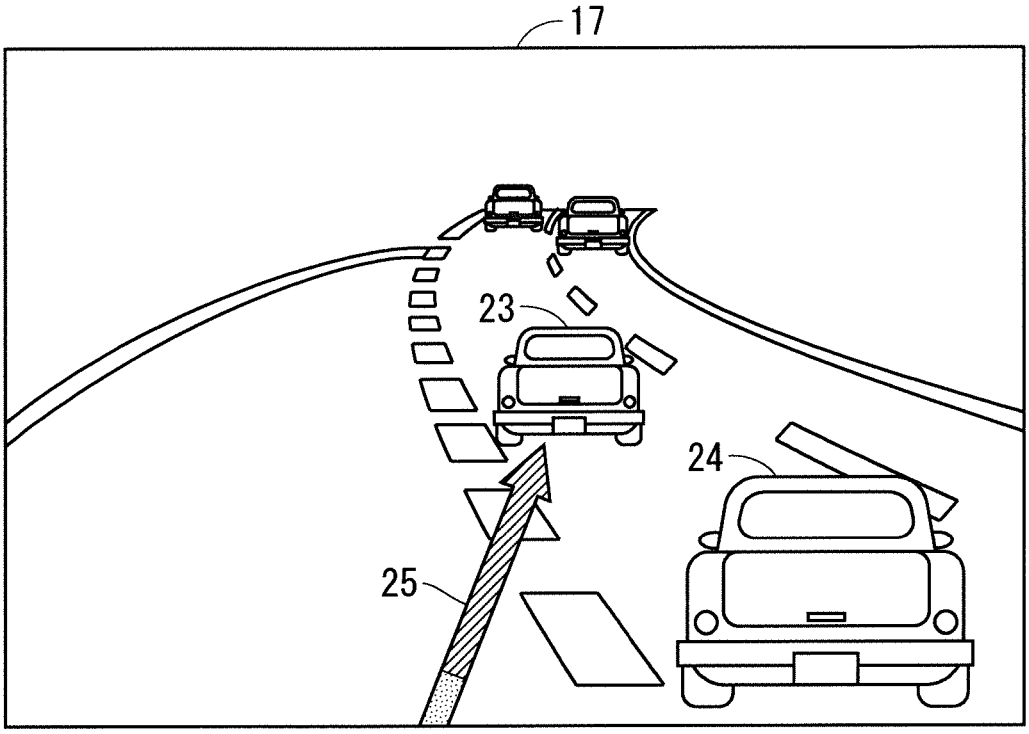
FIG. 28 illustrates one example of display for driving assistance according to Embodiment 2 of the present invention.
Figure 29:
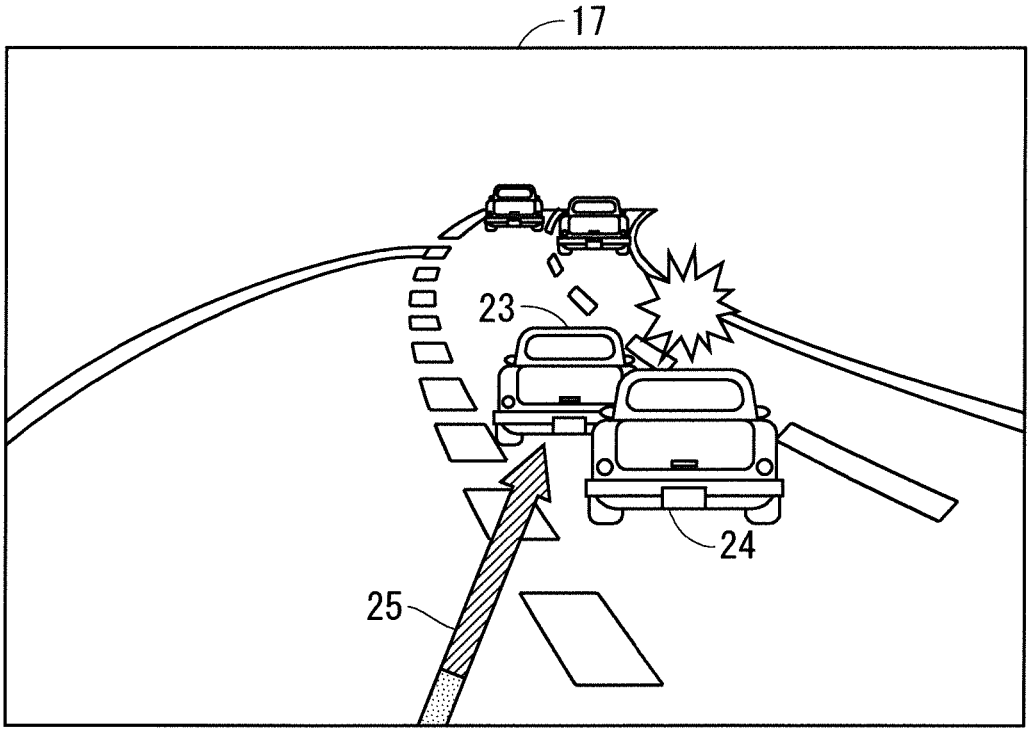
FIG. 29 illustrates one example of the display for driving assistance according to Embodiment 2 of the present invention.

FIGS. 28 and 29 illustrate one example of display for driving assistance, and illustrate one example of display of the travel location object and the merging prediction object. FIGS. 28 and 29 illustrate a case where the subject vehicle merges from the lane in which the subject vehicle travels to the lane in which the non-subject vehicle travels, but the same applies to a case where the subject vehicle changes lanes. The display device 17 in FIGS. 28 and 29 is the HUD.

As illustrated in FIG. 28, the display device 17 displays a travel location object 25 indicating the path from the current location of the subject vehicle to the point where the subject vehicle can merge calculated by the overall controller 14. A stippled area of the travel location object 25 indicates the location where the subject vehicle is currently to travel, and a hatched area of the travel location object 25 indicates the location where the subject vehicle is currently not to travel. The display device 17 also displays an imaginary subject vehicle 23 and an imaginary non-subject vehicle 24 respectively at the location that would become the location of the subject vehicle and the location that would become the location of the non-subject vehicle if the subject vehicle travels to the merging point at the current speed. The driver can thereby judge that the subject vehicle is not to come into contact with the non-subject vehicle when merging if the driver drives the subject vehicle at the current speed.

As illustrated in FIG. 29, the display device 17 displays the travel location object 25 indicating the path from the current location of the subject vehicle to the point where the subject vehicle can merge calculated by the overall controller 14. The stippled area of the travel location object 25 indicates the location where the subject vehicle is currently to travel, and the hatched area of the travel location object 25 indicates the location where the subject vehicle is currently not to travel. The display device 17 also displays the imaginary subject vehicle 23 and the imaginary non-subject vehicle 24 respectively at the location that would become the location of the subject vehicle and the location that would become the location of the non-subject vehicle if the subject vehicle travels to the merging point at the current speed. The imaginary subject vehicle 23 and the imaginary non-subject vehicle 24 are in contact with each other. In this case, the imaginary subject vehicle 23 and the imaginary non-subject vehicle 24 may be emphasized. The driver can thereby judge that it is necessary to accelerate or decelerate the subject vehicle because the subject vehicle is to come into contact with the non-subject vehicle when merging if the driver drives the subject vehicle at the current speed.

As described above, according to Embodiment 2, along with the location where the subject vehicle is currently to travel when the subject vehicle merges or changes lanes, the imaginary subject vehicle 23 and the imaginary non-subject vehicle 24 are displayed respectively at the location that would become the location of the subject vehicle and the location that would become the location of the non-subject vehicle if the subject vehicle travels to the merging point at the current speed. This allows for appropriate driving assistance to the driver when the subject vehicle merges or changes lanes.

Embodiment 3

A configuration of a driving assistance apparatus according to Embodiment 3 of the present invention is similar to that of the driving assistance apparatus 10 according to Embodiment 1, and thus detailed description thereof is omitted herein.

Figure 30:
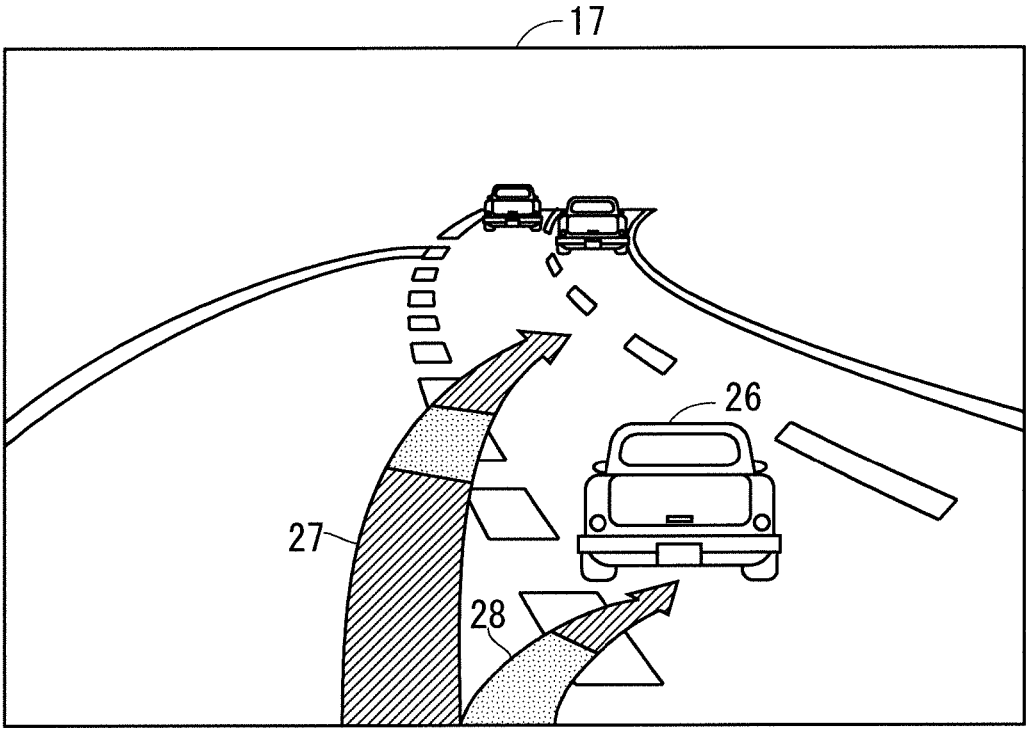
FIG. 30 illustrates one example of display for driving assistance according to Embodiment 3 of the present invention.

FIG. 30 illustrates one example of display for driving assistance, and illustrates one example of display of the travel location object. FIG. 30 illustrates a case where the subject vehicle merges from the lane in which the subject vehicle travels to the lane in which the non-subject vehicle travels, but the same applies to a case where the subject vehicle changes lanes. The display device 17 in FIG. 30 is the HUD.

As illustrated in FIG. 30, there are two points, in front of and behind a non-subject vehicle 26, where the subject vehicle can merge calculated by the overall controller 14. The display device 17 displays travel location objects 27 and 28 indicating paths from the current location of the subject vehicle to the points where the subject vehicle can merge calculated by the overall controller 14. Stippled areas of the travel location objects 27 and 28 indicate the location where the subject vehicle is currently to travel, and hatched areas of the travel location objects 27 and 28 indicate the location where the subject vehicle is currently not to travel. The driver can thereby judge that it is necessary to accelerate the subject vehicle if the subject vehicle merges in front of the non-subject vehicle 26. The driver can also judge that it is only necessary to drive the subject vehicle at the current speed if the subject vehicle merges behind the non-subject vehicle 26.

Figure 31:
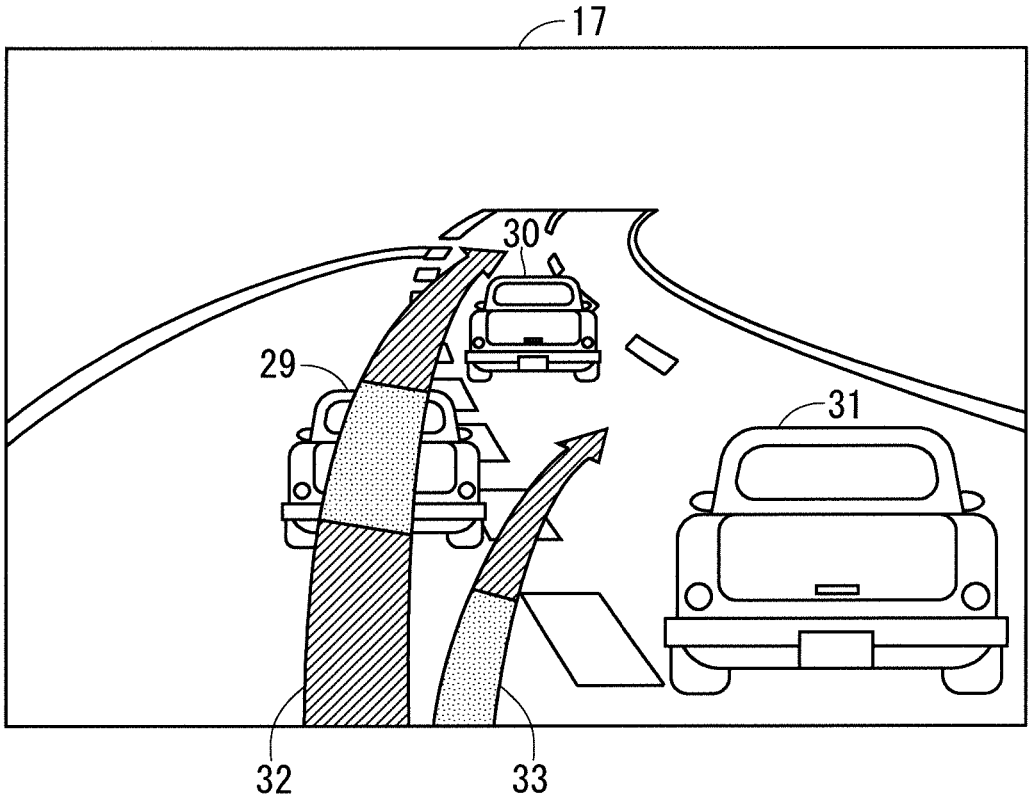
FIG. 31 illustrates one example of the display for driving assistance according to Embodiment 3 of the present invention.

FIG. 31 illustrates one example of display for driving assistance, and illustrates one example of display of the travel location object. FIG. 31 illustrates a case where the subject vehicle merges from the lane in which the subject vehicle travels to the lane in which the non-subject vehicle travels, but the same applies to a case where the subject vehicle changes lanes. The display device 17 in FIG. 31 is the HUD.

As illustrated in FIG. 31, there are two points, in front of a non-subject vehicle 30 and between the non-subject vehicle 30 and a non-subject vehicle 31, where the subject vehicle can merge calculated by the overall controller 14. The display device 17 displays travel location objects 32 and 33 indicating paths from the current location of the subject vehicle to the points where the subject vehicle can merge calculated by the overall controller 14. Stippled areas of the travel location objects 32 and 33 indicate the location where the subject vehicle is currently to travel, and hatched areas of the travel location objects 32 and 33 indicate the location where the subject vehicle is currently not to travel. In FIG. 31, a non-subject vehicle 29 is present on the path indicated by the travel location object 32, so that the subject vehicle cannot merge at the point in front of the non-subject vehicle 30. By seeing the travel location object 32, the driver can judge that it is only necessary to drive the subject vehicle at the current speed when the subject vehicle merges at the point in front of the non-subject vehicle 30 or at the point between the non-subject vehicles 30 and 31.

In FIG. 31, the travel location objects 32 and 33 may not be displayed when the lane to which the subject vehicle merges or changes lanes is congested. A portion of the travel location object 32 overlapping the non-subject vehicle 29 present in front of the subject vehicle in the same lane as the subject vehicle or the travel location object 32 as a whole may be translucent, may blink, or may not be displayed.

As described above, according to Embodiment 3, when there are a plurality of points where the subject vehicle can merge, the travel location object is displayed for each of the points. This allows for appropriate driving assistance to the driver when the subject vehicle merges or changes lanes.

Embodiment 4

In Embodiment 4 of the present invention, a case where the display device 17 is an electronic mirror to display an image behind the subject vehicle will be described. A configuration of a driving assistance apparatus according to Embodiment 4 is similar to that of the driving assistance apparatus 10 according to Embodiment 1, and thus detailed description thereof is omitted herein.

Figure 32:
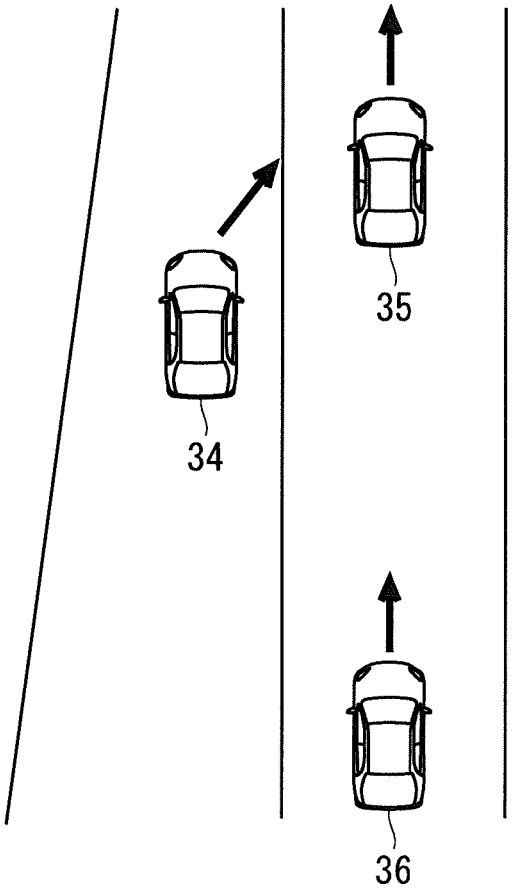
FIG. 32 is a diagram for explaining one example of operation of a driving assistance apparatus according to Embodiment 4 of the present invention.

FIG. 32 is a diagram for explaining one example of operation of the driving assistance apparatus according to Embodiment 4.

As illustrated in FIG. 32, a subject vehicle 34 is trying to merge at a point between non-subject vehicles 35 and 36. FIG. 32 illustrates a case where the subject vehicle merges, but the same applies to a case where the subject vehicle changes lanes.

Figure 33:
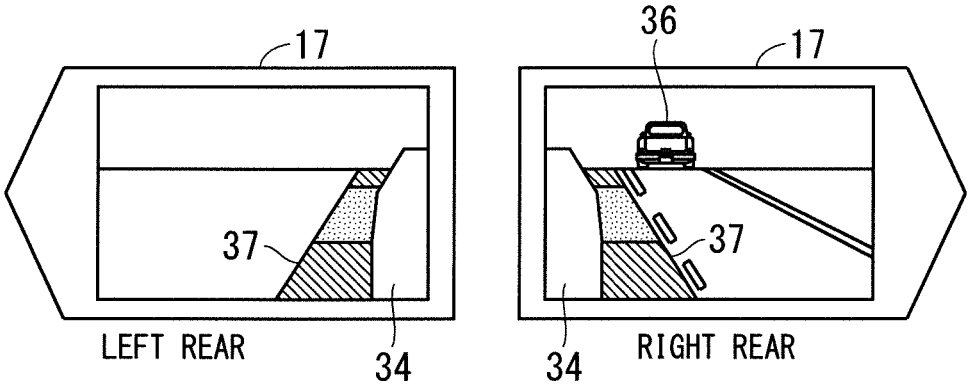
FIG. 33 illustrates one example of display for driving assistance according to Embodiment 4 of the present invention.

FIG. 33 illustrates one example of display for driving assistance, and illustrates one example of display of the travel location object. On the left side of FIG. 33, the display device 17 as the electronic mirror displays an image at the left rear of the subject vehicle 34. On the right side of FIG. 33, the display device 17 as the electronic mirror displays an image at the right rear of the subject vehicle 34.

As illustrated on the right side of FIG. 33, the display device 17 displays, on a lane behind the subject vehicle 34, a travel location object 37 indicating the location where the subject vehicle is currently to travel. A stippled area of the travel location object 37 indicates the location where the subject vehicle is currently to travel, and hatched areas of the travel location object 37 indicate the location where the subject vehicle is currently not to travel. The driver can thereby judge that it is necessary to decelerate the subject vehicle 34 when the subject vehicle 34 merges at the point between the non-subject vehicles 35 and 36.

As described above, according to Embodiment 4, the travel location object is displayed by the electronic mirror to display an image behind the subject vehicle. This allows for appropriate driving assistance to the driver when the subject vehicle merges or changes lanes.

A case where the display device 17 is the electronic mirror is described in Embodiment 4, but the display device 17 is not limited to the electronic mirror. For example, the display device 17 may have a configuration in which a transparent display panel is provided on the surface of a mirror to reflect the image behind the subject vehicle. In this case, the travel location object is displayed by the display panel.

Embodiment 5

In Embodiment 5 of the present invention, a case where the object generation unit 4 generates the travel location object responsive to the extent to which the subject vehicle can merge or change lanes will be described. A configuration of a driving assistance apparatus according to Embodiment 5 is similar to that of the driving assistance apparatus 10 according to Embodiment 1, and thus detailed description thereof is omitted herein.

Figure 34:
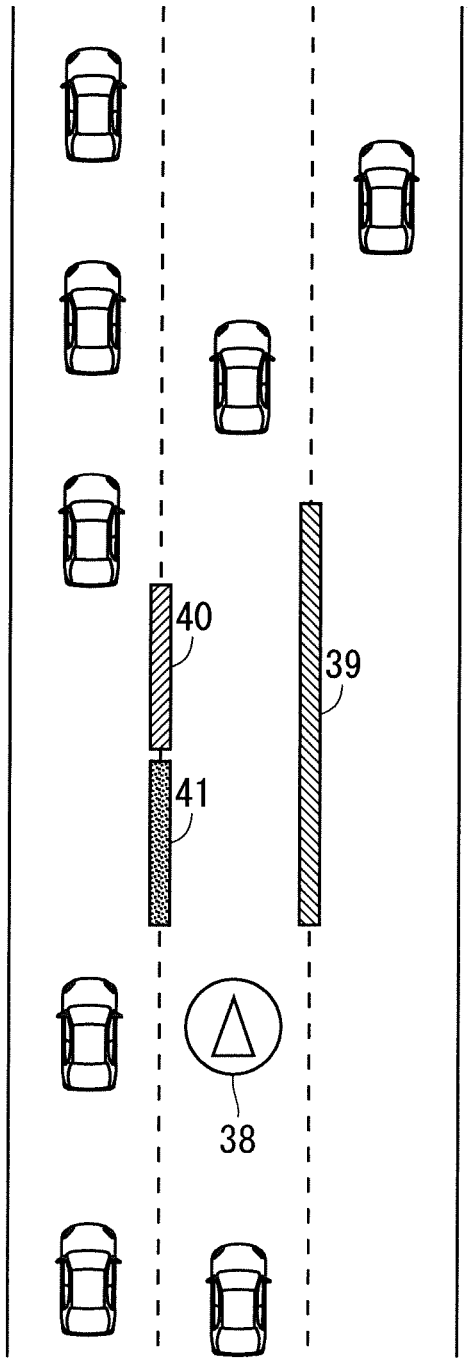
FIG. 34 is a diagram for explaining one example of operation of a driving assistance apparatus according to Embodiment 5 of the present invention.

FIG. 34 is a diagram for explaining one example of operation of the driving assistance apparatus according to Embodiment 5 of the present invention.

As illustrated in FIG. 34, the object generation unit 4 generates a travel location object including a lane changeable area 39, a lane changing caution area 40, and a lane unchangeable area 41. The lane changeable area 39 and the lane changing caution area 40 correspond to the location where a subject vehicle 38 is currently to travel. The lane unchangeable area 41 corresponds to the location where the subject vehicle 38 is currently not to travel. The overall controller 14 calculates each of the lane changeable area 39, the lane changing caution area 40, and the lane unchangeable area 41 based on the current location and the speed of the subject vehicle and the current location and the speed of the non-subject vehicle. The object generation unit 4 generates an object indicating each of the areas based on the result of calculation of the overall controller 14.

Figure 35:
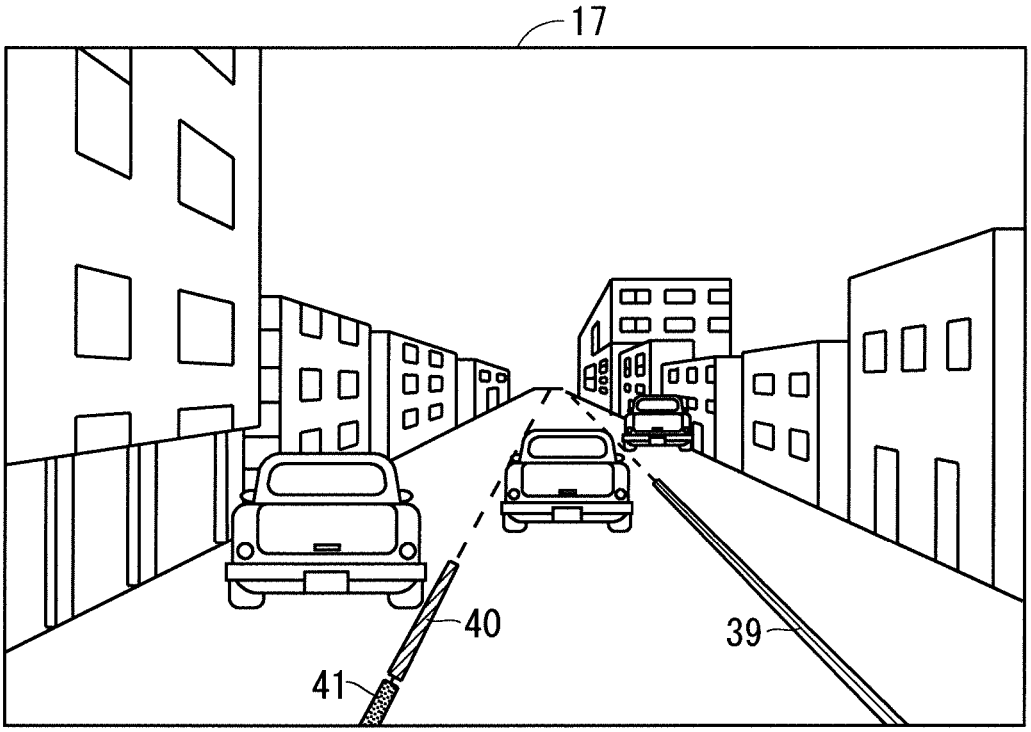
FIG. 35 illustrates one example of display for driving assistance according to Embodiment 5 of the present invention.

FIG. 35 illustrates one example of display for driving assistance according to Embodiment 5. In FIG. 35, the display device 17 is the HUD.

As illustrated in FIG. 35, the display device 17 displays the lane changeable area 39, the lane changing caution area 40, and the lane unchangeable area 41 superimposed on line markings so that they can be distinguished from one another. The driver can thereby judge a location where the subject vehicle can change lanes when changing lanes.

The display controller 5 may perform control to display or not to display the travel location object responsive to a predetermined event. The predetermined event herein includes, for example, provision of instructions by the driver of the subject vehicle using a direction indicator, detection of approach, to the subject vehicle, of the non-subject vehicle behind the subject vehicle, and making a gesture indicating that the subject vehicle changes lanes by the driver of the subject vehicle.

The display controller 5 may perform control to display the travel location object only on a line marking on a side of changing lanes.

A case of changing lanes is described above, but the same applies to a case of merging. Embodiment 5 is applicable to Embodiments 1 to 4.

As described above, according to Embodiment 5, the travel location object is displayed responsive to the extent to which the subject vehicle can merge or change lanes. This allows for appropriate driving assistance to the driver when the subject vehicle merges or changes lanes.

The driving assistance apparatus described above is applicable not only to an in-vehicle navigation device, i.e., a car navigation device but also to a navigation device or a device other than the navigation device constructed, as a system, by appropriately combining a portable navigation device (PND) mountable on a vehicle, a server provided external to the vehicle, and the like. In this case, the functions or the components of the driving assistance apparatus are distributed to functions constructing the above-mentioned system.

Figure 36:
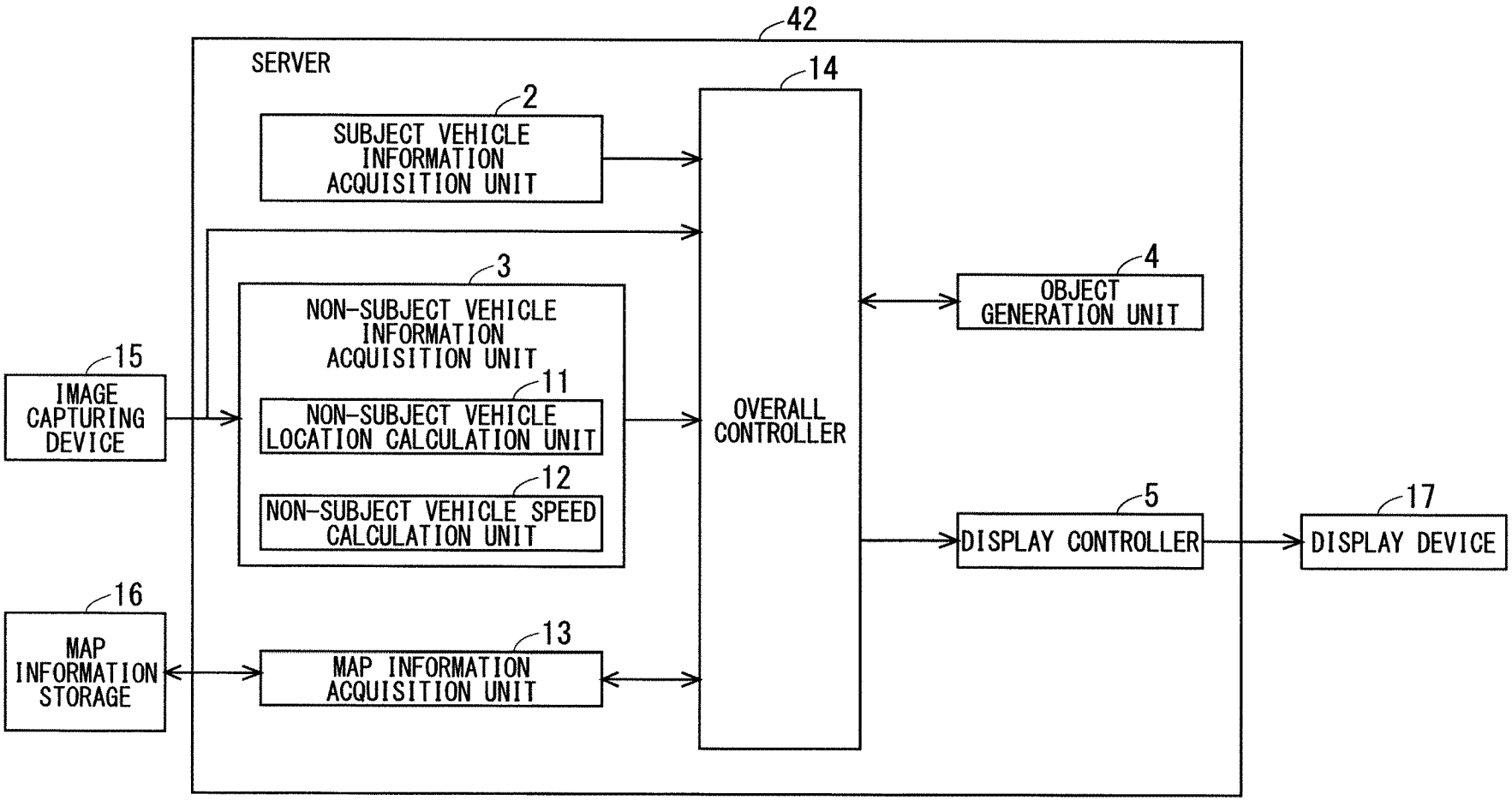
FIG. 36 is a block diagram showing one example of a configuration of a driving assistance system according to the embodiments of the present invention.

Specifically, as one example, the functions of the driving assistance apparatus can be placed in the server. For example, as shown in FIG. 36, the image capturing device 15 and the display device 17 are provided on a user side. A server 42 includes the subject vehicle information acquisition unit 2, the non-subject vehicle information acquisition unit 3, the object generation unit 4, the display controller 5, the non-subject vehicle location calculation unit 11, the non-subject vehicle speed calculation unit 12, the map information acquisition unit 13, and the overall controller 14. The map information storage 16 may be included in the server 42 or provided external to the server 42. A driving assistance system can be constructed with such a configuration.

As described above, even with a configuration in which the functions of the driving assistance apparatus are distributed to the functions constructing the system, an effect similar to that obtained in the above-mentioned embodiments can be obtained.

Software to perform operation in the above-mentioned embodiments may be incorporated, for example, into the server. A driving assistance method achieved by the server executing the software includes: acquiring subject vehicle information including a current location and a speed of a subject vehicle; acquiring non-subject vehicle information including a current location and a speed of a non-subject vehicle; generating, based on the acquired subject vehicle information and the acquired non-subject vehicle information, a travel location object indicating at least one of a location where the subject vehicle is currently to travel and a location where the subject vehicle is currently not to travel when the subject vehicle merges or changes lanes from a lane in which the subject vehicle travels to a lane in which the non-subject vehicle travels; and displaying, in accordance with travel of the subject vehicle, the generated travel location object superimposed on scenery around the subject vehicle.

An effect similar to that obtained in the above-mentioned embodiments can be obtained by incorporating the software to perform operation in the above-mentioned embodiments into the server, and operating the software.

Embodiments of the present invention can freely be combined with each other, and can be modified or omitted as appropriate within the scope of the invention.

While the invention has been described in detail, the foregoing description is in all aspects illustrative and not restrictive. It is understood that numerous modifications not having been described can be devised without departing from the scope of the present invention.

EXPLANATION OF REFERENCE SIGNS

1 driving assistance apparatus, 2 subject vehicle information acquisition unit, 3 non-subject vehicle information acquisition unit, 4 object generation unit, 5 display controller, 6 subject vehicle, 7 to 9 non-subject vehicle, 10 driving assistance apparatus, 11 non-subject vehicle location calculation unit, 12 non-subject vehicle speed calculation unit, 13 map information acquisition unit, 14 overall controller, 15 image capturing device, 16 map information storage, 17 display device, 18 processor, 19 memory, 20 travel location object, 21 non-subject vehicle, 22 acceleration and deceleration object, 23 imaginary subject vehicle, 24 imaginary non-subject vehicle, 25 travel location object, 26 non-subject vehicle, 27 and 28 travel location object, 29 to 31 non-subject vehicle, 32 and 33 path object, 34 subject vehicle, 35 and 36 non-subject vehicle, 37 travel location object, 38 subject vehicle, 39 lane changeable area, 40 lane changing caution area, 41 lane unchangeable area, 42 server.

The invention claimed is:

1. A driving assistance apparatus comprising:

a processor to execute a program; and a non-transitory memory to store the program which, when executed by the processor, performs processes of:

acquiring subject vehicle information including a current location and a speed of a subject vehicle;

acquiring, from an in-vehicle device, non-subject vehicle information including a current location and a speed of a non-subject vehicle relative to the subject vehicle;

generating, based on the acquired subject vehicle information and the acquired non-subject vehicle information, a travel location object indicating a location where the subject vehicle is currently to travel and a location where the subject vehicle is currently not to travel when the subject vehicle merges or changes lanes from a lane in which the subject vehicle travels to a lane in which the non-subject vehicle travels; and controlling a display such that the generated travel location object is superimposed on scenery around the subject vehicle such that the location where the subject vehicle is currently to travel and the location where the subject vehicle is currently not to travel as shown in accordance with travel of the subject vehicle.

2. The driving assistance apparatus according to claim 1, wherein the controlling process comprises controlling the display such that the travel location object is superimposed on a line marking forming the lane in which the subject vehicle travels.

3. The driving assistance apparatus according to claim 1, wherein the controlling process comprises controlling the display such that the travel location object is superimposed on the lane in which the subject vehicle travels.

4. The driving assistance apparatus according to claim 1, wherein the generating process comprises generating the travel location object responsive to an extent to which the subject vehicle is capable of merging or changing lanes.

5. The driving assistance apparatus according to claim 4, wherein the controlling process comprises controlling the display such that the travel location object is superimposed on a line marking located in a direction of merging or changing lanes from among line markings constituting the lane in which the subject vehicle travels.

6. The driving assistance apparatus according to claim 4, wherein the controlling process comprises controlling the display such that the travel location object is superimposed or not superimposed responsive to a predetermined event.

7. The driving assistance apparatus according to claim 1, wherein the generating process comprises generating an acceleration and deceleration object indicating that the subject vehicle currently needs to be accelerated or decelerated using characters or a symbol.

8. The driving assistance apparatus according to claim 1, wherein the travel location object indicates a path from the current location of the subject vehicle to a point where the subject vehicle is capable of merging or changing lanes, and the generating process comprises generating an object indicating an imaginary subject vehicle being the subject vehicle that is imaginary and located at the point.

9. The driving assistance apparatus according to claim 8, wherein the generating process comprises generating an object indicating that the imaginary subject vehicle and an imaginary non-subject vehicle being the non-subject vehicle that is imaginary are in contact with each other at the point.

10. The driving assistance apparatus according to claim 1, wherein when there are a plurality of points where the subject vehicle is capable of merging or changing lanes, the travel location object indicates a path from the current location of the subject vehicle to each of the points.

11. The driving assistance apparatus according to claim 10, wherein the controlling process comprises controlling the display such that the object is not superimposed when the lane to which the subject vehicle merges or changes lanes is congested, and controlling the display such that the object is superimposed when the lane to which the subject vehicle merges or changes lanes is not congested.

12. The driving assistance apparatus according to claim 1, wherein the controlling process comprises controlling the display such that the travel location object is superimposed on a lane which is behind the subject vehicle and in which the subject vehicle travels.

13. The driving assistance apparatus according to claim 1, wherein the superimposed travel location object graphically distinguishes the location where the subject vehicle is currently to travel from the location where the subject vehicle is currently not to travel thereby guiding a driver of the subject vehicle to accelerate the subject vehicle when needed.

14. The driving assistance apparatus according to claim 1, wherein the travel location object is generated when the subject vehicle merges or changes lanes from the lane in which the subject vehicle travels to the lane in which the non-subject vehicle travels without changing a travel speed.

15. The driving assistance apparatus according to claim 1, wherein the in-vehicle device is an image capturing device.

16. A driving assistance method comprising:

acquiring subject vehicle information including a current location and a speed of a subject vehicle;

acquiring, from an in-vehicle device, non-subject vehicle information including a current location and a speed of a non-subject vehicle relative to the subject vehicle;

generating, based on the acquired subject vehicle information and the acquired non-subject vehicle information, a travel location object indicating a location where the subject vehicle is currently to travel and a location where the subject vehicle is currently not to travel when the subject vehicle merges or changes lanes from a lane in which the subject vehicle travels to a lane in which the non-subject vehicle travels; and controlling a display such that the generated travel location object is superimposed on scenery around the subject vehicle such that the location where the subject vehicle is currently to travel and the location where the subject vehicle is currently not to travel as in accordance with travel of the subject vehicle.

17. The driving assistance method according to claim 16, wherein the superimposed travel location object graphically distinguishes the location where the subject vehicle is currently to travel from the location where the subject vehicle is currently not to travel thereby guiding a driver of the subject vehicle to accelerate the subject vehicle when needed.

18. The driving assistance method according to claim 16, wherein the travel location object is generated when the subject vehicle merges or changes lanes from the lane in which the subject vehicle travels to the lane in which the non-subject vehicle travels without changing a travel speed.

19. The driving assistance method according to claim 16, wherein the in-vehicle device is an image capturing device.

* * * * *